US005820736A

United States Patent [19]

Bouziane et al.

[11] Patent Number: 5,820,736

[45] Date of Patent: Oct. 13, 1998

[54] PYROLYSING APPARATUS

[76] Inventors: Richard Bouziane, 1630 Ch. du Brûlé , St-Antoine sur Richelieu, Québec, Canada, J0L 1R0; Rodier Michaud, 24, rue du Sous-Bois, Tracy, Québec, Canada, J3R 2Y5

[21] Appl. No.: 780,084

[22] Filed: Dec. 23, 1996

[51] Int. Cl.[6] ..... C10B 1/06; C10B 25/06

[52] U.S. Cl. ..... 202/136; 202/137; 202/247; 202/249

[58] Field of Search ..... 202/100, 136, 202/242, 247, 250, 252, 137, 249

[56] References Cited

U.S. PATENT DOCUMENTS

| | | | |
|---|---|---|---|
| 4,250,158 | 2/1981 | Solbakken et al. | 423/449 |
| 4,308,103 | 12/1981 | Rotter | 202/117 |
| 4,374,704 | 2/1983 | Young | 202/117 |
| 4,412,889 | 11/1983 | Oeck | 202/117 |
| 5,095,040 | 3/1992 | Ledford | 521/40.5 |
| 5,220,873 | 6/1993 | Milsap, III | 110/240 |
| 5,264,640 | 11/1993 | Platz | 585/241 |
| 5,285,101 | 2/1994 | Breu | 202/131 |
| 5,411,714 | 5/1995 | Wu et al. | 422/232 |
| 5,608,136 | 3/1997 | Maezawa et al. | 588/228 |
| 5,662,052 | 9/1997 | McIntosh et al. | 110/346 |
| 5,670,024 | 9/1997 | Baltzer et al. | 201/25 |

*Primary Examiner*—Nina Bhat
*Attorney, Agent, or Firm*—Francois Martineau

[57] ABSTRACT

This apparatus can effect pyrolysis of hydrocarbon containing material at high temperature of 400° to 500° C. and under vacuum in consecutive batches. The apparatus comprises a cylindrical drum rotatable at a variable speed about a horizontal axis and spacedly surrounded by a heat insulating sheath; a gas burner heats the rotating drum along its entire length from the exterior of the same; a chimney communicates with the space between the drum and the sheath, which has ventilation openings closable by trap doors; the drum is supported by bearings so to allow its axial thermal expansion. A manifold system of filters is stationarily mounted within the rotating drum to filter out fine solid residues from the pyrolytic gases and vapors. This manifold is connected to a discharge tube which exits from one end of the drum and is fitted with a sealing joint to seal the drum around the stationary discharge tube. This joint has a passage for admitting into the drum emergency inert gas to prevent atmospheric air into the drum in the event of an accidental leak of the rotary joint. The drum has an access door and a system to swing the door open and to properly seal the door in position on the drum.

25 Claims, 18 Drawing Sheets

PYROLYSING APPARATUS

FIELD OF THE INVENTION

The present invention relates to an apparatus for pyrolysing recyclable hydrocarbon containing materials by a pyrolysing batch process. The apparatus is more particularly designed for pyrolysing used rubber tires.

BACKGROUND OF THE INVENTION

A process for the treatment of used rubber tires by vacuum pyrolysis to produce liquid and gaseous hydrocarbons and a solid carbonaceous material is disclosed in U.S. Pat. No. 4,740,270 dated Apr. 26, 1988, inventor Christian Roy. A similar method is disclosed by the same inventor in U.S. Pat. No. 4,839,020 dated Jun. 13, 1989, this patent being directed to the treatment of petroleum derived organic sludges or residues. The reactor described in patent 270 is shown as a vertical container enclosing a series of vertically spaced heated trays, each adapted to receive a bed of tire cuttings and each heated at a progressively higher temperature from top to bottom of the container. The process described appears to be a continuous process in which case no description is given of the type of seals which would be required at the entrance and exit of the reactor to perform the process under vacuum; if mercury seals were to be used, the produced gases and vapors would be liable to be contaminated by mercury. This patent does not teach how to effect the process in a batch reactor.

OBJECTS OF THE INVENTION

It is therefore the general object of the present invention to provide an apparatus for pyrolysing hydrocarbon containing materials, more particularly under vacuum, the apparatus being designed to carry out a batch process.

Another object of the present invention resides in the provision of an apparatus of the character described which is designed to pyrolyse an important quantity of recyclable hydrocarbon containing material at high temperature of about 400 to 500 degrees centigrade and under a vacuum of less than about 35 mm of mercury to obtain a maximum yield of useful oils and gaseous hydrocarbons together with useful carbon black when such recyclable material contain the same.

Another object of the present invention is to provide an apparatus of the character described incorporating a rotatable drum for containing the material to be pyrolysed and designed to be heated at high temperature and provided with effective seals at the drum inlet and outlet tube to prevent entry of atmospheric air within the drum even if the latter is under vaccum.

Another object of the present invention is to provide a filtering system inside the drum to filter out any carbon black powder from the gas and vapors discharged from the drum during the batch process.

Another object of the present invention is to provide a system for rapidly cooling the drum upon completion of the process so that the drum may be unloaded and reloaded in a minimum of time between each batching operation.

SUMMARY OF THE INVENTION

The pyrolysing apparatus of the present invention comprises a base structure, a drum having a front and a back end wall and supported on said base structure for rotation about a generally horizontal axis, drive means for rotating said drum, said drum having an access opening in said front end wall for loading materials to be pyrolysed and for unloading solid residues, a door removably closing said access opening in an airtight manner, heating means located adjacent and exteriorly of said drum for heating the same as it rotates and its contents at a high temperature in an oxygen free atmosphere, a heat insulating sheath spacedly surrounding said drum and secured to said base structure, a chimney mounted on said base structure communicating with the space between said drum and said sheath, a stationary discharge tube having an upwardly offset portion located within said drum and a co-axial portion extending through said back end wall, co-axial with said drum axis and fixedly supported on said base structure outwardly of said drum, and sealing means between said drum and said stationary discharge tube.

Preferably, the apparatus, further includes a sleeve co-axial with and spacedly surrounding said discharge tube co-axial portion, secured to the exterior of said back end wall, back bearing means for rotatably supporting said sleeve and for preventing axial displacement thereof and front bearing means for rotatably supporting said drum at said front end wall while allowing axial thermal expansion of said drum.

Preferably, the sheath has circular end openings co-axial with said drum and further including drum supporting front and back discs co-axial with said drum, secured to said end walls exteriorly of said drum, and spaced from said end walls, heat insulation between said discs and said end walls, said discs closing said sheath end openings.

Preferably, the front end wall has an external stud shaft on the exterior of and co-axial with said drum and suppported by said front bearing and further including a bearing support lever arm pivoted to said base structure and to said front bearing for allowing axial displacement of said front bearing.

As an alternative, said external stud shaft and front bearing are replaced by two rollers which support the front end wall supporting disc on each side of the drum axis.

Preferably, there are means to adjust the spacing of said two rollers transverse to said drum.

Preferably, said offset portion of said discharge tube is straight and parallel to said drum axis and a series of filters depend from a communicate with said offset portion.

Preferably, the offset portion of said discharge tube has a closed end proximate said front end wall and an internal stud shaft is fixed to said front end wall, protrudes within said drum to rotatably support a collar which in turn supports said offset portion adjacent said closed end by a lever which allows longitudinal thermal expansion and contraction of said discharge tube axially of and relative to said drum.

Preferably, a sleeve is fixed to the insulated disc of the back end wall exteriorly of the same, said back bearing surrounding said sleeve and supporting the same. Preferably, the sealing means include a sealing tube, co-axial with said drum, secured to said drum and extending exteriorly of the same spacedly through said sleeve, said sealing tube rotatably surrounding said co-axial portion of said discharge tube, and a rotary sealing joint between said sealing tube and said co-axial portion of said discharge tube, said rotary joint located exteriorly of said sleeve and of said back bearing.

Preferably, said rotary joint includes a sealing tube collar fixed to the outer end of said sealing tube, a common radial pad carried by said sealing tube collar, a discharge tube collar fixed to said co-axial discharge tube portion, a pair of concentric radial pads sliding on and in sealing engagement with said common radial pad, a pair of concentric accordeon tubes surrounding said co-axial discharge tube portion, sealingly and respectively secured to said pair of radial pads and to said discharge tube collar, the space between said pair of radial pads and said concentric tubes communicating with a source of inert gas at a higher pressure than atmospheric pressure, so as to prevent entrance of outside air within said drum when said drum is under vacuum and which might be due to leakage between said common pad and said concentric pads.

Preferably, the passage between said co-axial discharge tube portion and the inner one of said concentric accordeon tubes communicates with the inside of the drum through the space between said sleeve and said co-axial discharge tube portion for connection to a pressure transducer.

As an alternative, the rotary joint includes a packing gland formed of two sets of packing rings pressed against said rotating sealing tube and secured to said axial discharge tube portion, and further including spacer means between said two sets of packing rings, in communication with said source of inert gas under pressure.

Preferably, the drive means for the drum include a large diameter gear wheel fixed to the exterior of the disc carried by the drum back end wall and spacedly surrounding said back bearing, and a variable speed power drive carried by said base structure is in driving engagement with said gear wheel.

Preferably, the chimney includes a butterfly valve to close the same, and said sheath is provided with ventilation openings communicating with the atmosphere and disposed below said drum, and trap doors for closing said ventilation openings, whereby once said trap doors are opened, outside air circulates by convection around said drum and is discharged through said chimney.

Preferably, power operated blower means further circulates cooling air within the space between said sheath and said drum.

Preferably the drum access opening is eccentrically disposed with respect to the drum axis.

Preferably a swinging arm is pivotally connected to the base structure at one end and is removably pivotally connected to said door at its other end, said arm holding the drum door in a drum closing position and swinging said door to an out of the way position when the drum access opening is upper most to permit loading and unloading of said drum.

Preferably, the door is part of a door assembly providing means to effectively seal the door around the drum access opening; these means include a door support, rotary interlocking means carried by said door support and by said front end wall around the drum access opening to lock said door support to said front end wall by a limited angle of rotation of said door support relative to said front end wall, said door being supported by said door support for relative axial movement but against relative radial movement. A nut is secured to said door support, a screw is screwed within said nut and pushes a pressure pad against the center of said door; a screwdriver is mounted within a sleeve for rotation therewith and for limited axial movement between advanced and retracted positions respectively engaging and releasing said screw; a handle carried by said screwdriver for axially shifting and rotating the same and also for axially shifting said sleeve relative to said screwdriver and for rotating said sleeve; inter-engagable means are carried by said door support and by said sleeve which are inter-engaged and released in respective advanced and retracted positions of said sleeve. Therefore, the sleeve is advanced and rotated by the handle to rotate and lock the door support, then the sleeve is retracted and the screwdriver is advanced and rotated to press said door in sealing engagement with said end wall around said access opening. The door assembly is removably supported by said swing arm through said sleeve and permanent magnets which releasably adhere to the door assembly.

As an alternative, the door assembly includes a central holder and a peripheral ring secured to and outwardly protruding from said door, heat insulation filling said ring around said central holder, a circular seal between said door and the edge of said access opening, said ring registering with the door seal when said door is in closed position, and pressure exerting means are carried by the drum front end wall insulated disc to press said ring against said door and the latter directly against said seal. The door assembly is removably supported by said swing arm through said central holder.

In one embodiment, said pressure exerting means are hydraulic swing cylinders carried by the drum front end wall insulated disc and clamp arms carried and actuated by said swing cylinders between an operative position pressing against said ring and an inoperative position clearing said ring.

In another embodiment, said pressure exerting means include a threaded collar secured to drum front end wall insulated disc and co-axial with said access opening and through which said door may pass, and a threaded cap releasably screwed on said collar and rotatably carried by said door assembly, said cap having a radially inner cylindrical flange rotatable relative to and registering with said ring.

Preferably, the apparatus further includes heat transmitting fins protruding from and secured to the inside of said drum and extending in planes normal to the drum axis.

Preferably, the heat insulating sheath is provided with a longitudinal slot parallel to the drum axis and vertically below the same, said slot having a length equal to the length of said drum, said heating means including a series of burner nozzles extending within said slot.

DESCRIPTION OF THE DRAWINGS

In the drawings.

In the drawings, like reference characters indicate like elements throughout.

DETAILED DESCRIPTION OF THE PREFERRED EMBODIMENTS OF THE INVENTION

Figure 1:
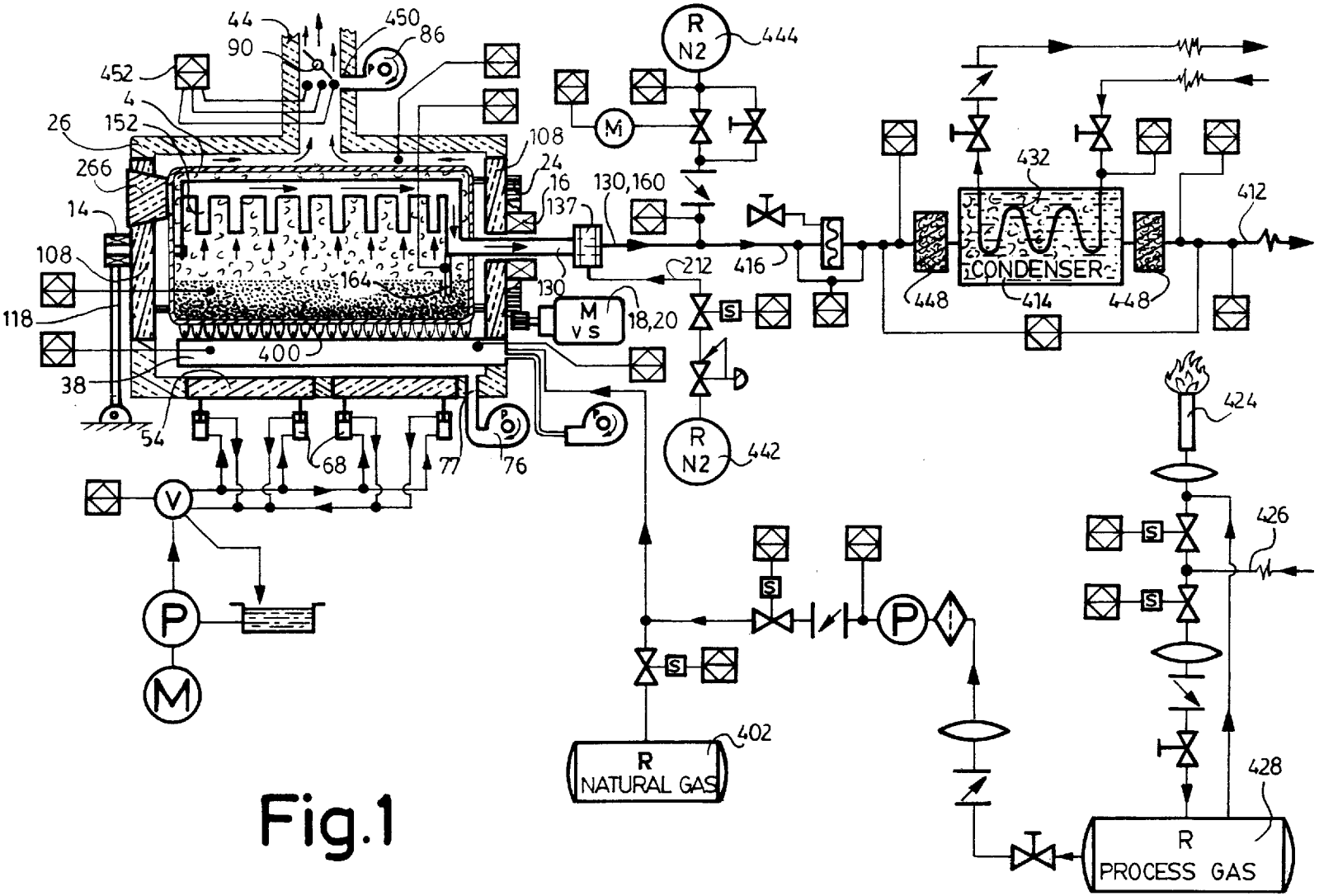
FIG. 1 is a schematic view of the apparatus in accordance with the invention and of the first part of a flow diagram of the equipment used for the pyrolysing process.

Referring to FIGS. 4 to 6, 15 and 16, the apparatus of the invention comprises a base structure 2 supporting a drum 4 of cylindrical shape and including a front end wall 6 and a back end wall 8. End wall 6 has an access opening 10, which is radially off-set from the drum axis and which is closed in airtight manner by a door 12. Drum 2 is designed to be heated up to about 500° and placed under a vacuum of less than 35 mm Hg. Drum 4 is supported for rotation about a horizontal axis by a front bearing 14 and a rear bearing 16. Drum 4 is rotated at a variable speed by an electric motor 18, a speed reducing box 20, and a pinion 22 meshing with a large diameter gear wheel 24 co-axial with the drum axis and secured to the back end wall 8 through means to be described hereinafter. (see also FIG. 20).

Drum 4 typically has a length of about 20 feet and a diameter of 8 feet.

Figure 15:
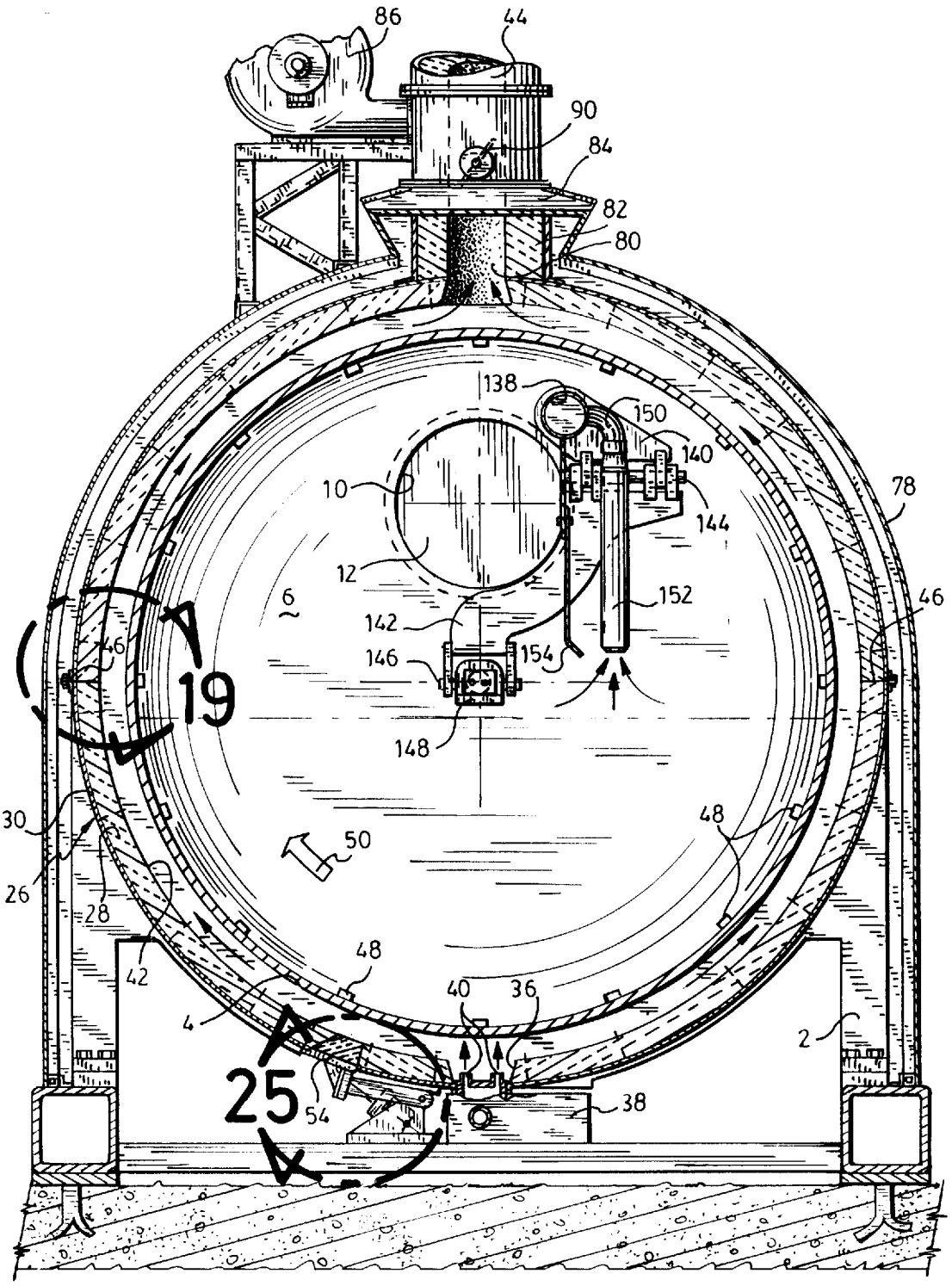
FIG. 15 is a vertical cross section taken along line 15—15 of FIG. 4.
Figure 19:
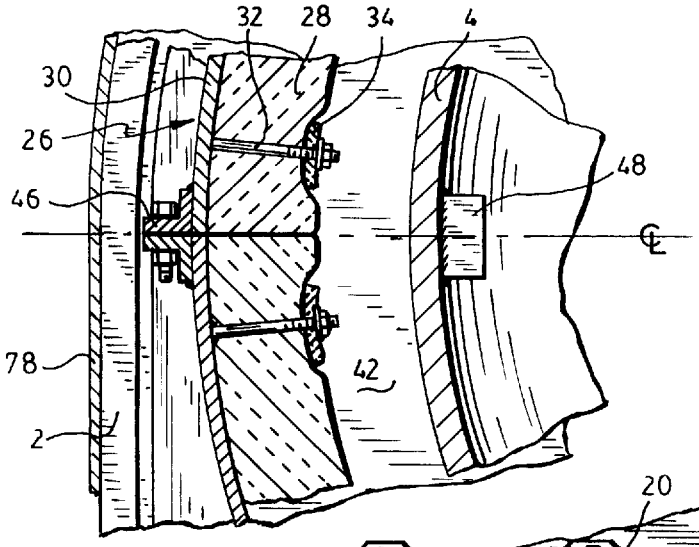
FIG. 19 is a cross section taken in area 19 of FIG. 15.
Figure 25:
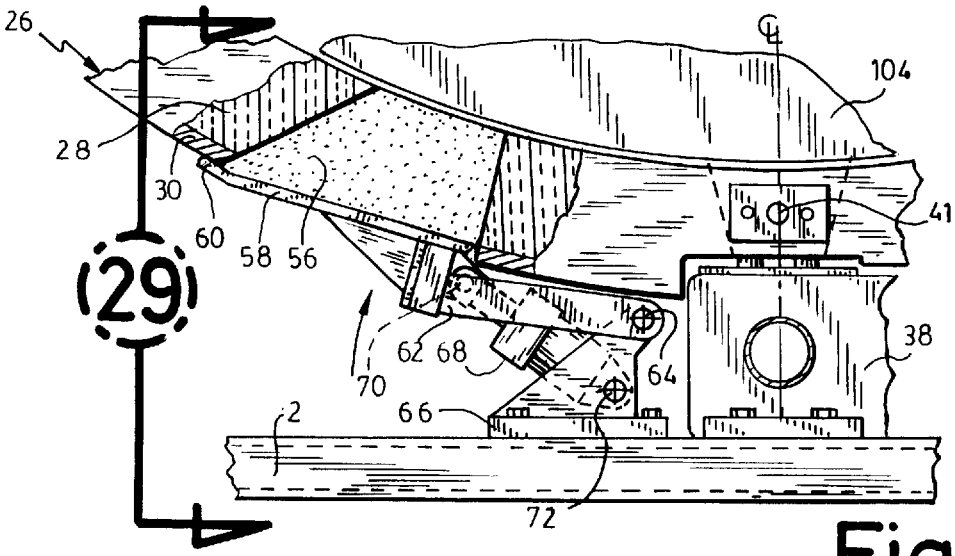
FIG. 25 and 26 are enlarged views taken in area 25 of FIG. 15 and showing the trap doors in close and open position respectively.
Figure 26:
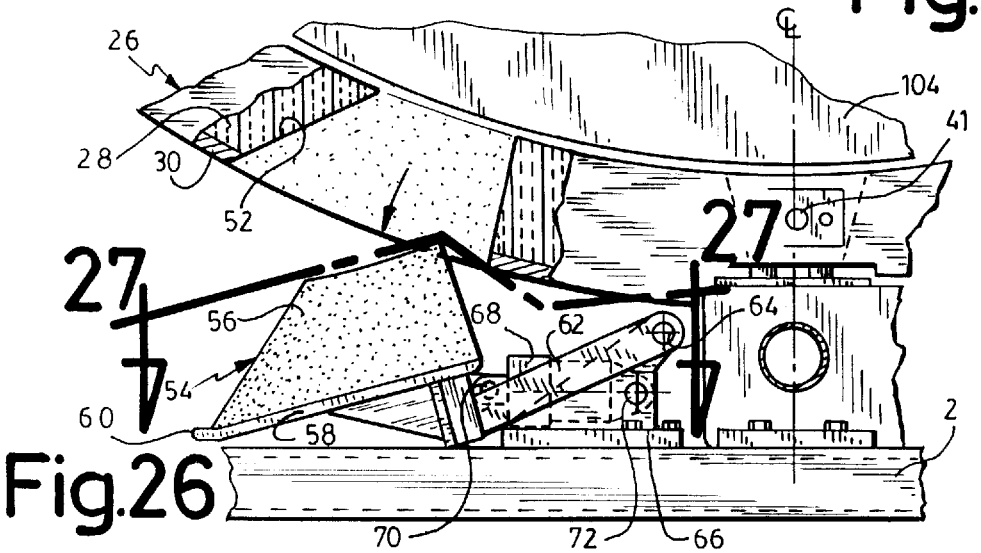
Figure 27:
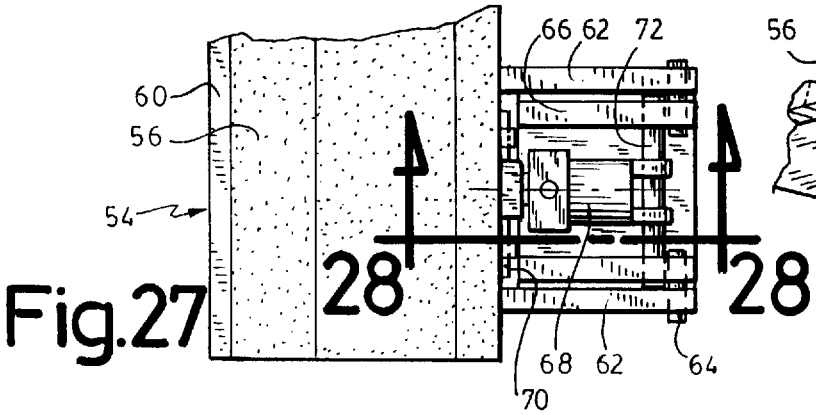
FIG. 27 is a top plan view of the trap door and its operating mechanism taken along line 27—27 of FIG. 26.
Figure 28:
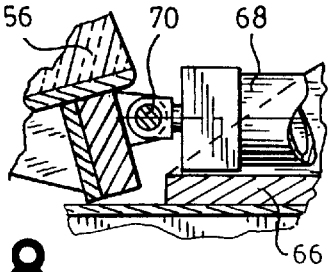
FIG. 28 is a partial vertical section taken along line 28—28 of FIG. 27.
Figure 29:
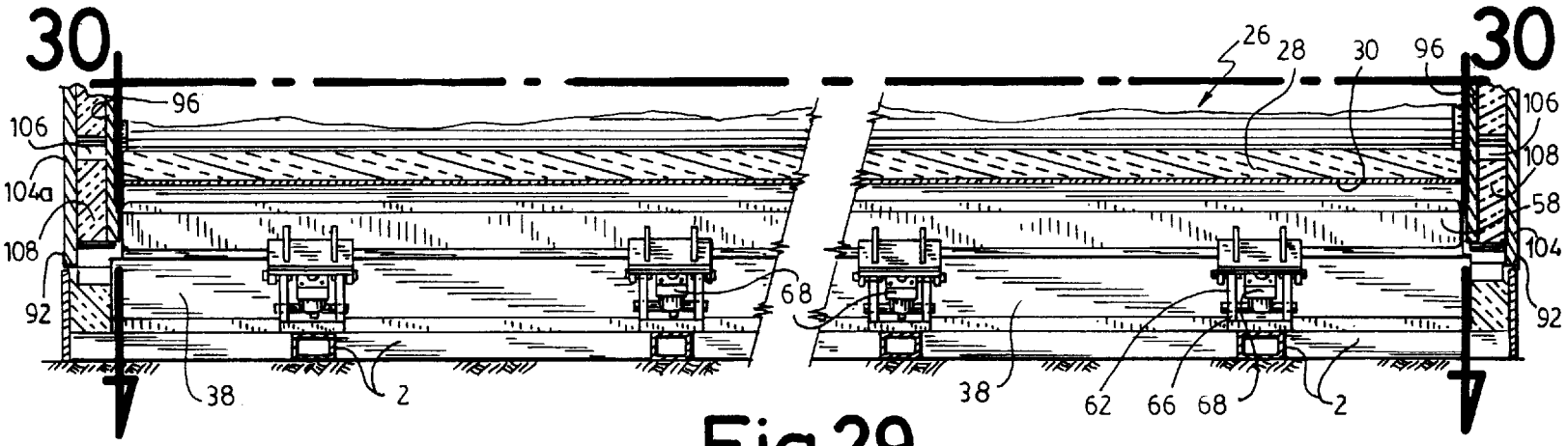
FIG. 29 is a longitudinal cross section taken along line 29 of FIG. 25.
Figure 30:
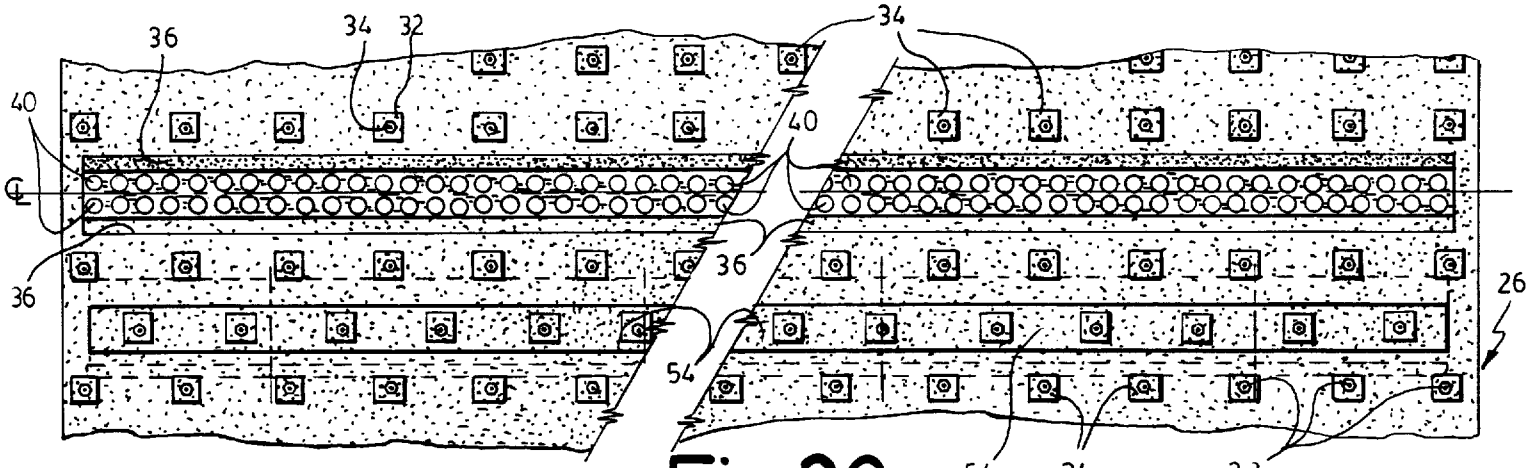
FIG. 30 is a partial plan view of the insulating sheath and burners taken along line 30—30 of FIG. 29.

Drum 4 is spacedly enclosed by a cylindrical heat insulating sheath 26 secured to the base structure 2 and formed by insulating ceramic panels 28 secured to the inside of a cylindrical metal envelope 30 by pins 32 and retainer plates 34. (See FIGS. 15 and 30) Sheath 26 is provided with a longitudinal slot 36 parallel to the drum axis disposed vertically below the same. A gas burner 38, supported by the base structure 2, has a plurality of burner nozzles 40 extending through slot 36 to directly heat the external surface of the drum 4 as the same is rotating. Nozzles 40 are exposed to pilot lights 38*a* (FIG. 3) fed by piping extending through hole 41 at the ends of burner 38 (see FIGS. 25, 26). The gas flames surround the drum 4 within the annular space 42 between the drum and the sheath 26. The burnt gases escape through one or more chimneys 44 communicating with space 42 and vertically disposed directly above the drum axis. As shown in FIGS. 15 and 19, the sheath 26 is made of two half sections each of semi-cylindrical shape which are united by a joint 46. The top sheath section can be removed for the installation and removal of the drum 4 and its accessories.

FIGS. 15 and 19 also show heat transmitting fins 48 welded to the inside of the drum 4 and normal to the drum axis. Fins 48 increase the heat transfer from the drum to the comminuted material being pyrolysed but yet without shoveling the material to the top of the drum as the latter rotates in direction of arrow 50.

As shown in FIGS. 15 and 25 to 30, means are provided to rapidly cool the drum at the end of each batch operation in order to decrease as much as possible the time interval between each operation and during which the drum is unloaded and reloaded. Aligned cooling slots 52 are made in sheath 26, parallel to and adjacent burner slot 36 under drum 4. Each cooling slot 52*a* has radially inwardly tapered cross section as shown in 26 and is closed during pyrolysing operations by a trap door 54 which includes an insulating strip 56 supported by backing metal plate 58. Strip 56 has a radially inwardly tapered shape to fit cooling slot 52 while backing plate 58 has a lip 60 which makes a lap joint with the edge of the metal enveloppe 30.

Each trap door 54 is supported on the base structure 2 for movement between open and closed position by means of longitudinally spaced pair of lever arms 62, secured to backing plate 58 and pivoted at 64 to brackets 66 bolted to the base structure 2. A single acting pneumatic hydraulic cylinder 68 is pivoted to plate 58 at 70 and to bracket 66 at 72. Extension of cylinders 68 produces closing of the trap doors 54 from the open position shown in FIG. 26 to the closed position shown in FIG. 25. During the pyrolysing operation, the door are closed and they are opened between these operations to permit atmospheric air to be sucked from under sheath 26 through cooling slots 52, space 42 and chimneys 44. If desired, drum cooling can be accelerated by circulating forced cooling air within space 42 by means of a power operated cooling fan 76, (see FIG. 1) connected to a tube 77 extending through sheath 56 (see also FIG. 6).

Referring to FIGS. 4, 6, 15 and 16, it is seen that the two chimneys 44 are supported by an external sheath enclosing metal envelope 78 in turn supported by the base structure 2. The two chimneys 44 communicate with a longitudinal chimney slot 80 made in sheath 26 and which extends substantially the entire length of the drum 4. Slot 80 is diametrically opposite to and parallel to the burner slot 36. Chimney slot 80 communicates with a superposed insulated conduit 82 extending the whole length of the sheath 26 on top of metal enveloppe 78 as clearly shown by comparing of FIGS. 4 and 5 and also shown in FIG. 15. Conduit 82 in turn communicates with each chimney 44 through an upwardly tapering conduit 84 (see FIG. 4). An electric air fan 86 can supply cooling air to each chimney 44 in order to cool transducers 88 located within the chimneys, (see FIG. 1) just below a motorized butterfly damper 90.

Since drum 4 must be heated to very high temperatures for the pyrolysing operations, its two end walls 6 and 8 are heat insulated and also the bearings 14 and 16 are heat insulated as much as possible while still supporting the drum for rotation. Finally, the bearings must be mounted so as to allow heat expansion of the drum in the axial direction.

Cylindrical sheath 26 define full size cylindrical openings 92 at each end of the base structure 2 said openings 92 being co-axial with the drum axis and of a slightly greater diameter than the drum diameter.

Referring to FIGS. 16, 17, 21 and 22, a circular metal strip 94 is welded to back end wall 8 and a flat ring 96 is secured to strip 94 by a series of shoulder bolts 98 each surrounded by a metal spacer washer 101 with the provision of an intermediate heat insulating circular strip 100. To allow for differential radial thermal expansion and contraction of drum 4 and ring 96, each bolt 98 extends through a radially elongated hole 102 made in ring 96. A clearance J of about 20 mils allow relative radial movement between the bolts 98 and the ring 96. It will be noted that at any instant in the rotation of the drum, the equivalent of half the bolts 98 positively support the drum.

A metal disk 104 is spacedly secured to the flat ring 96 by metal spacers 106 welded at circular intervals to disk 104 and ring 96. Heat insulating material 108 fills the space between ring 96 and disk 104. The assembly of strip 94, ring 96 heat insulating strip 100 and metal disk 104 is co-axial with a drum axis. Metal disk 104 closes the circular opening 92 of sheath 26 and a sealing strip, not shown, may be provided at the joint between the rotating disk 104 and the stationary sheath 26.

Figure 6:
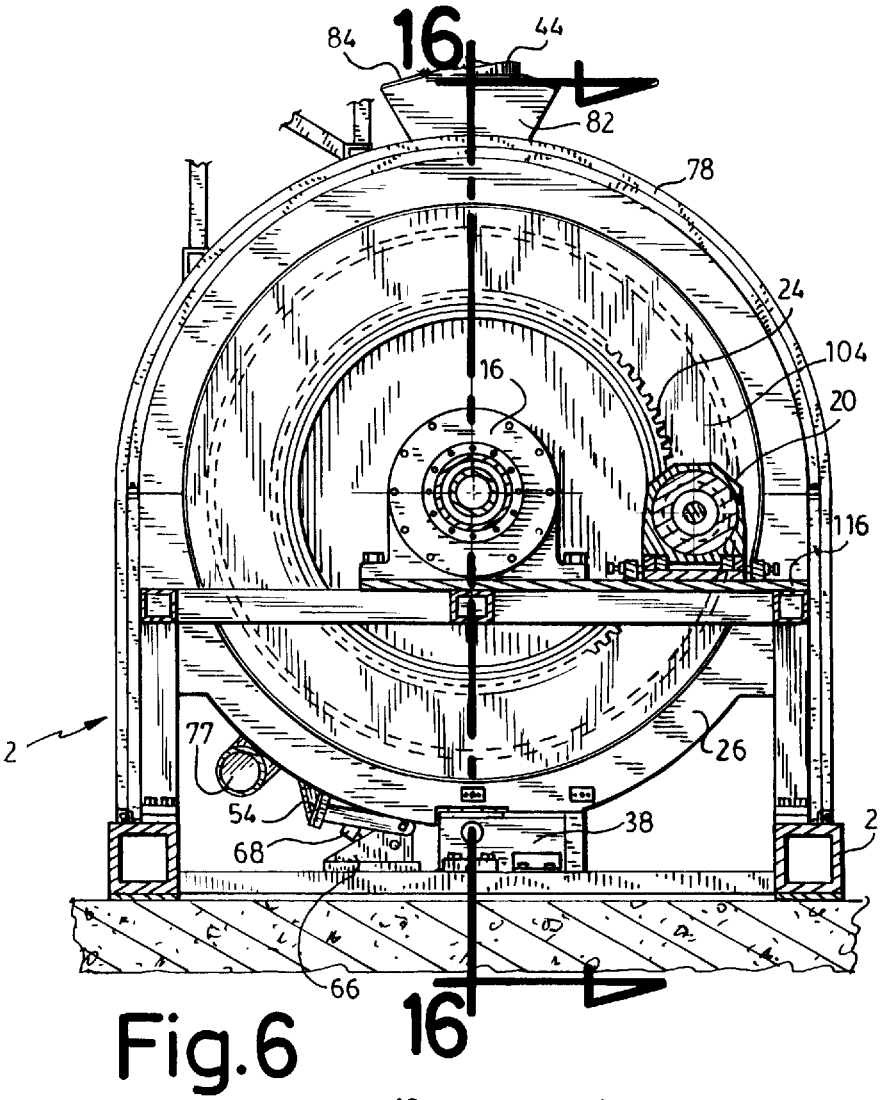
FIG. 6 is a vertical section taken along line 6—6 of FIG. 4.

As shown in FIG. 6, gear wheel 24 is mounted co-axial with the drum axis on the outside of disk 104 by means of an annular suppport 110 welded to disk 104 and spacedly surrounding the rear bearing assembly 16. Disk 104 has a central hole which registers with a sleeve 112 co-axial with the drum axis, bolted to disk 104 and protruding outwardly of the same. Rear bearing 16 is a combined radial and axial trust bearing, preferably a spherical bearing with a double row of rollers; it surrounds sleeve 112 to support the same by its inner race while its outer race is supported on a table 116 which is part of base structure 2.

Figure 5:
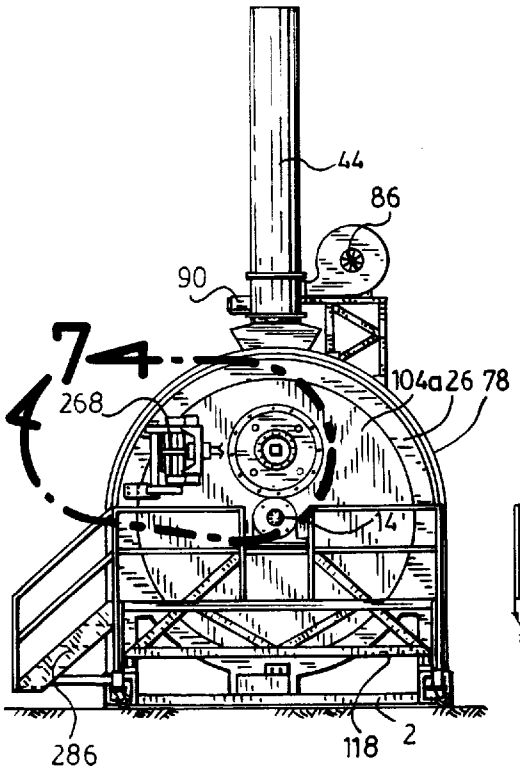
Figure 16:
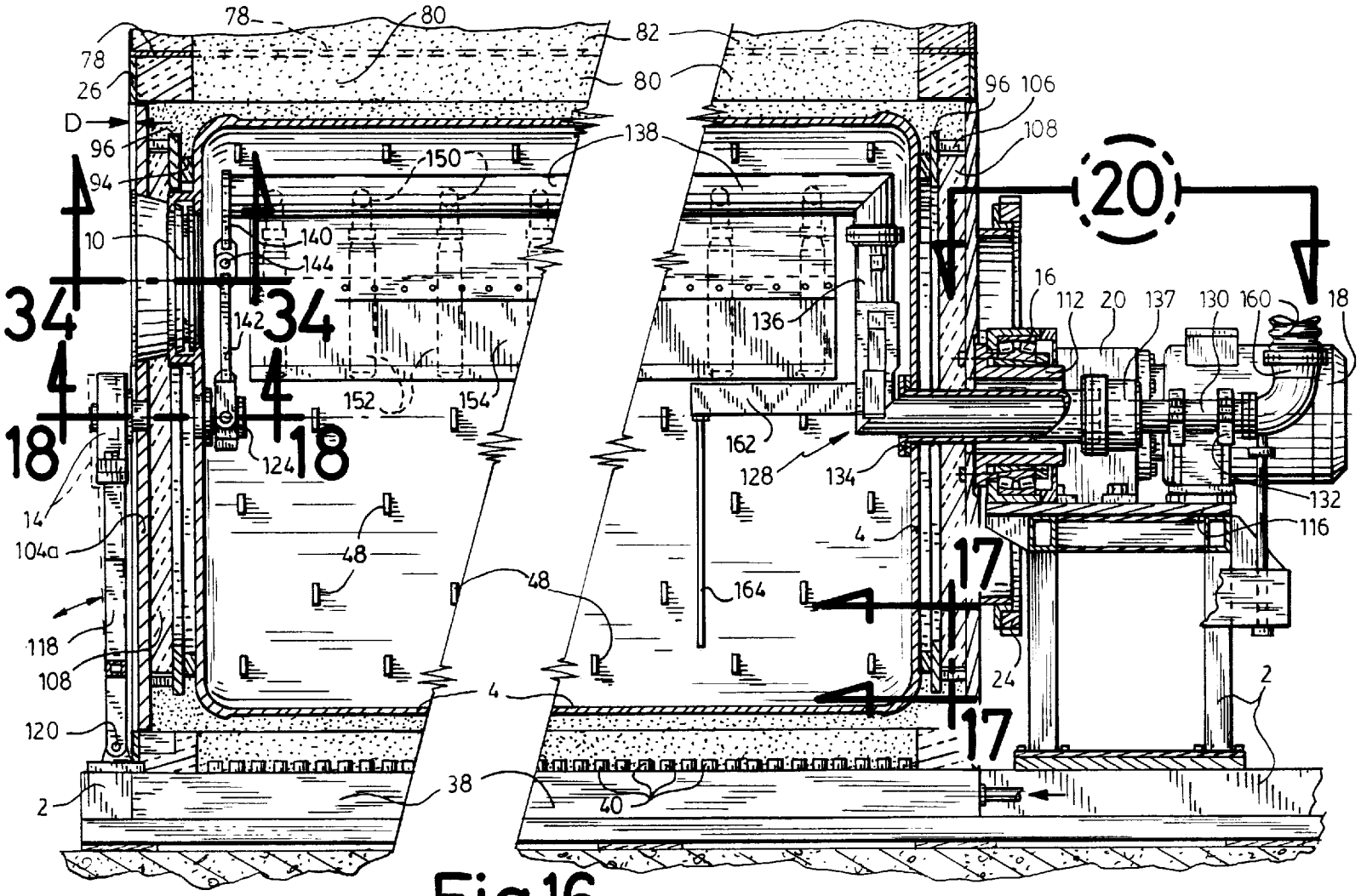
FIG. 16 is a longitudinal section of the apparatus of the invention showing the rotating drum, its support bearings, its drive, its filter assembly and discharge tube, and the enclosing heat insulating sheath.
Figure 17:
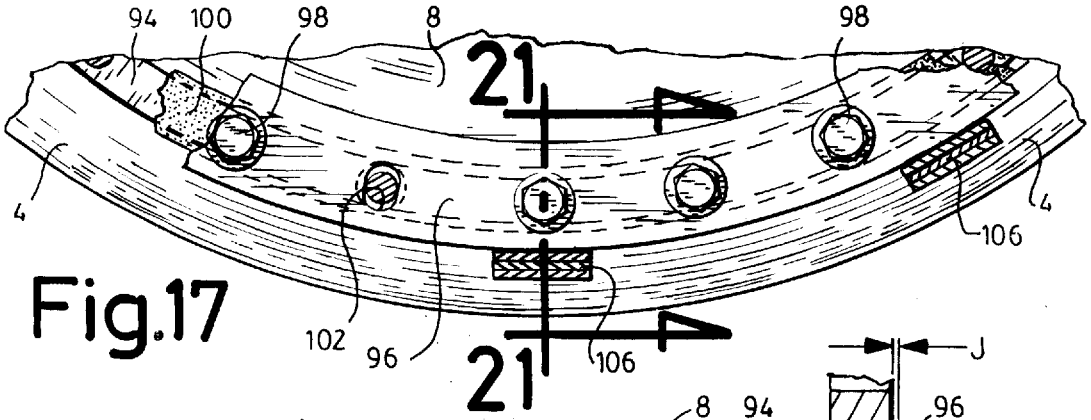
FIG. 17 is a partial section taken along line 17—17 of FIG. 16.
Figure 21:
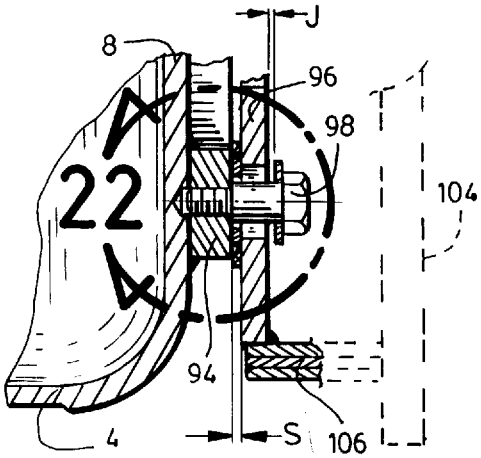
FIG. 21 is a partial cross section taken along line 21—21 of FIG. 17.
Figure 22:
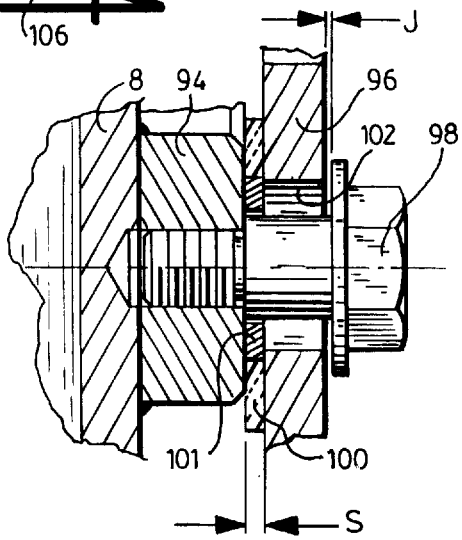
FIG. 22 is an enlarged cross section taken in area 22 of FIG. 21.
Figure 18:
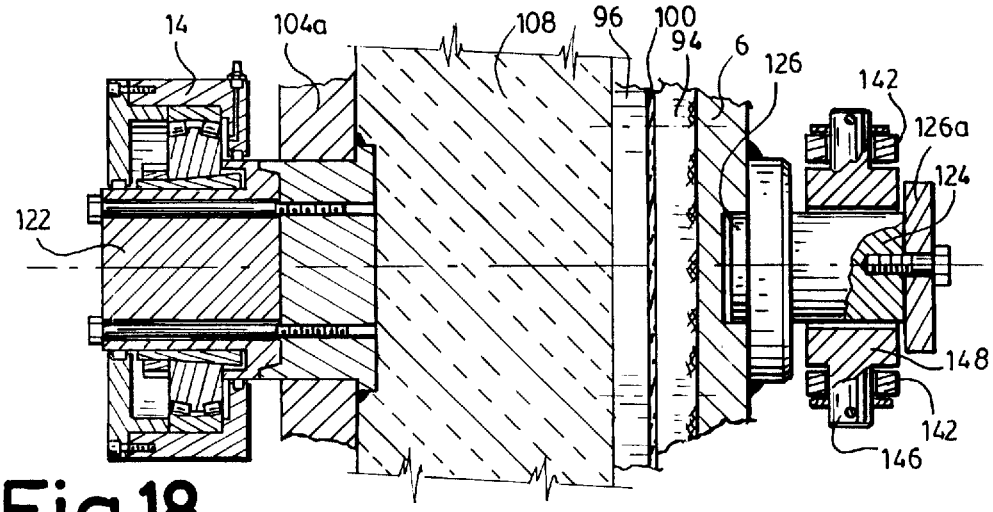
FIG. 18 is a partial section taken along line 18—18 of FIG. 16.

As shown in FIGS. 5, 16 and 18, the front bearing 14 is supported by a lever arm 118 of triangular shape, (see FIG. 5) and which is pivoted at its lower end by pivots 120 to base structure 2 so that the bearing 14 may have an axial play as indicated in dotted lines in FIG. 16 to allow for thermal expansion and contraction of the drum as indicated by reference D.

It should be noted that the front end wall 6 is also provided with a heat insulating and drum supporting assembly including strip 94, flat ring 96, bolts 98, heat insulating strip 100 and metal disk 104 with the spacers 106 together with the heat insulation 108. Disk 104A for the front end wall 6 of drum 4 is not centrally bored and provided with a sleeve 112 but is fitted with an external stud shaft 122, (see FIG. 18) which is co-axial with the drum axis. Front bearing 14 is mounted on stud shaft 122, as shown. FIGS. 16 and 18 also shows an internal stud shaft 124 which is co-axial with rotary drum 4 and inwardly protrudes therein being secured to the front end wall 6. Stud shaft 124 is welded to end wall 6 after having being centered by fitting its inner end within a central circular cavity 126 previously machined in the inner face of front end wall 6. A similar external stud shaft centering cavity is made in disc 104*a*.

During the pyrolysing operation, the hydrocarbon containing content of the material within drum 4 is converted into vapor and gases which are discharged to the exterior of the rotating drum by a stationary discharge tube 128 which is composed of three sections rigidly interconnected, namely sections 130, 136 and 138. Section 130 is co-axial with the drum 4, issues from the back end wall 8 of the drum 4 and is firmly secured to the table 116 of the structure 2 by clamps 132 (see also FIG. 2). Discharge tube section 130 freely extends within a sealing tube 134 which is rigidly secured to the center of the back end wall 8, is sealed thereto and rearwardly protrudes freely through sleeve 112 and is fitted with a rotary sealing joint generally indicated at 137 which seals tube 134 and discharge tube section 130 as will be hereinafter described and illustrated in FIGS. 23 and 24.

Section 136 of discharge tube 128 (see FIGS. 15 and 16) is upwardly extending and connects co-axial section 130 with section 138 which is horizontal, straight and extends practically the entire length of the drum 4 and which is parallel to and is vertically upwardly off-set from the drum axis. Offset tube section 138 is completely closed by cap 140 at its front end and is supported through cap 140 on internal stud shaft 124 by means of a curved arm 142 which is pivotally connected to cap 140 at its upper end by means of a pivot 144 while its lower end is pivoted by a lower pivot 146 to a collar 148 (see FIG. 18) which is rotatable on inner stud shaft 124 and retained thereon by a retainer washer 126*a*. Both pivots 144 and 146 are horizontal and transverse to the drum axis, they allow differential thermal expansion and contraction in an axial direction between the drum 4 and the discharge tube 128.

As shown in FIG. 15, arm 142 is curved so that the top discharge tube section 138 is maintained in a position which is laterally off-set from the access opening 10 of drum 4. Top discharge tube section 138 is provided with a series of elbows forming a manifold 150 to which are connected a series of filters 152 of cylindrical shape which vertically extend within the drum 4, are closed at their lower end and which preferably have a wire mesh of about 4 microns. These filters, which are laterally offset from access opening 10, are protected from the material being loaded through the access opening by a shield plate 154 secured to and depending from top discharge tube section 138. Shield plate 154 also protects the filters 152 during the pyrolysing operation from impingement by solid material lifted as the drum rotates in direction 50. Referring again to FIG. 16, it will be noted that the vapors and gases circulating through discharge tube 128 do not affect rear bearing 16 since the latter is heat insulated from the discharge tube section 130 by the air space between sealing tube 134 and sleeve 112.

Figure 2:
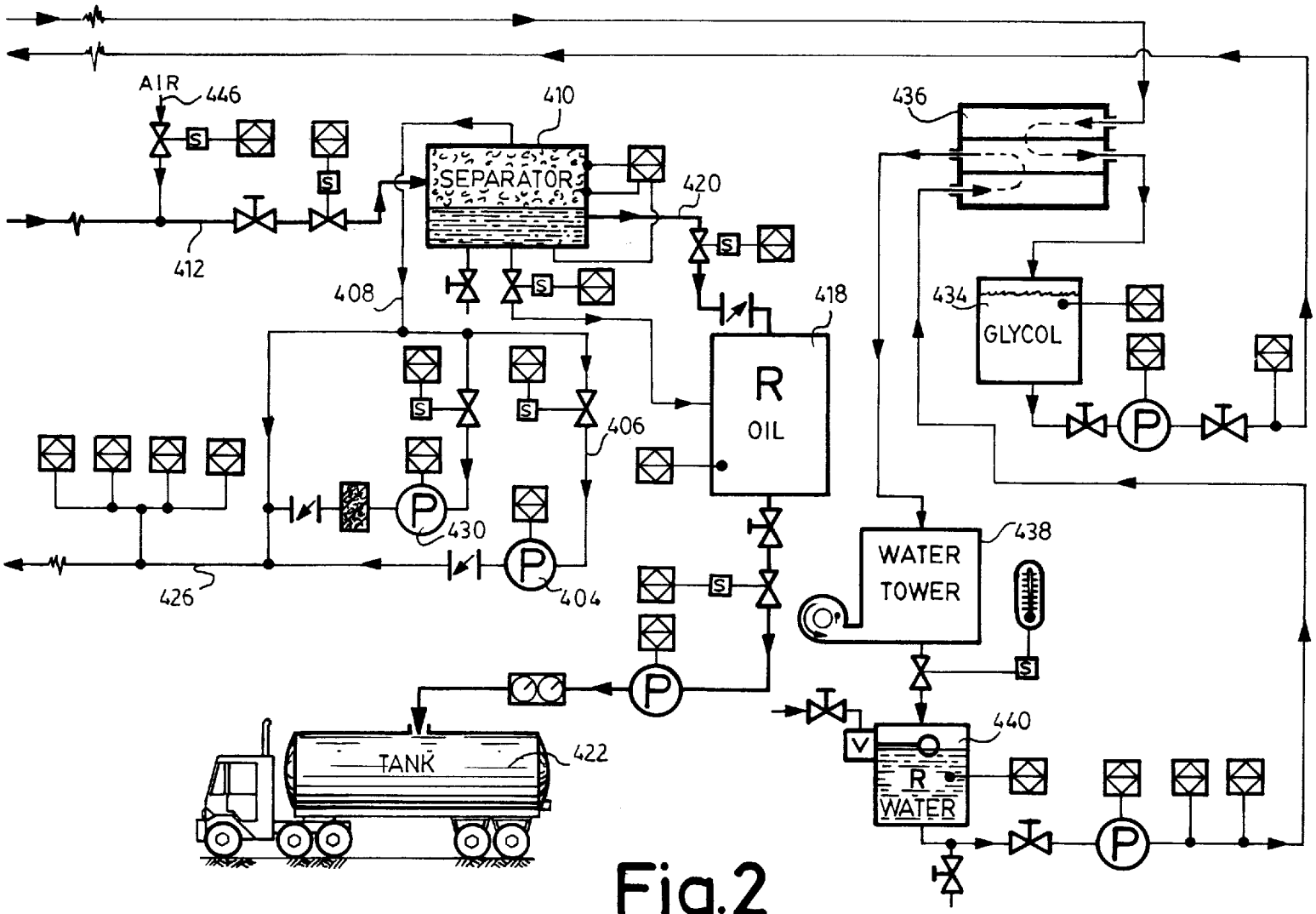
FIG. 2 is a continuation of the flow diagram of FIG. 1.
Figure 3:
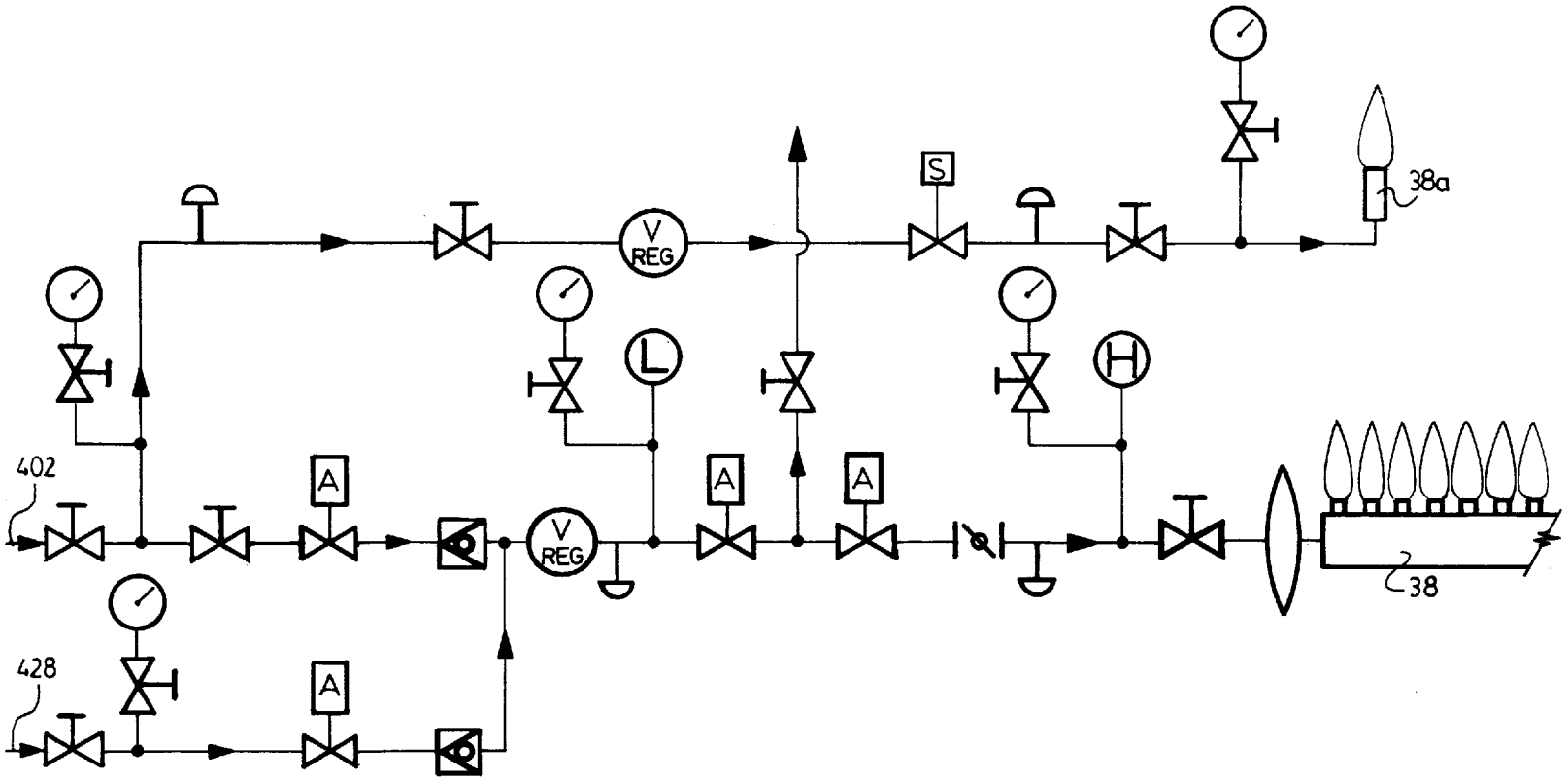
FIG. 3 is a flow diagram of the system for operating the gas burner of the pyrolysing apparatus of the invention.
Figure 4:
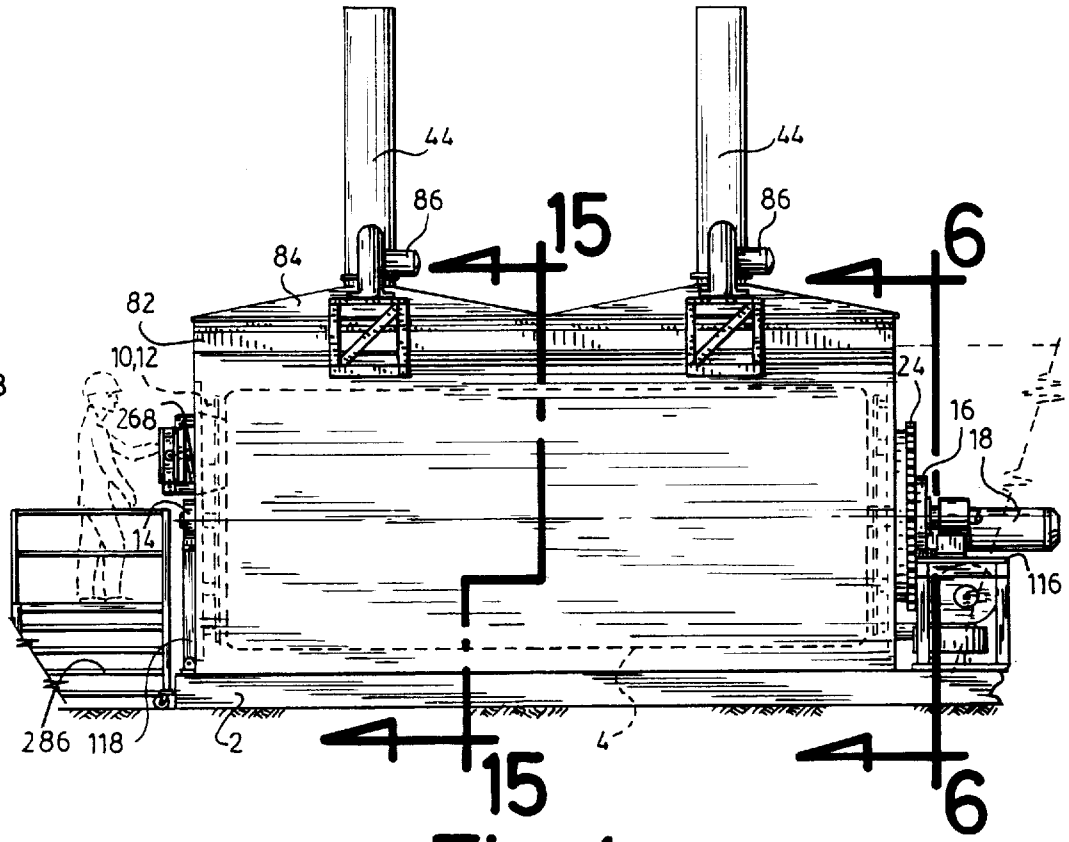
FIGS. 4 and 5 are a side elevation and a front end view of the apparatus of the invention.

The vapors and gases are directed by a conduit 160 fixed to tube section 130 to processing equipment which is schematically shown in FIGS. 1, 2 and 3 to be described hereinafter.

Referring to FIG. 16, an arm 162 is secured to the lower part of intermediate discharge tube section 136 and extends within the drum and carries a rod 164, the tip of which is equipped with a temperature sensor which is immersed into the comminuted solid material being pyrolysed.

Figure 20:
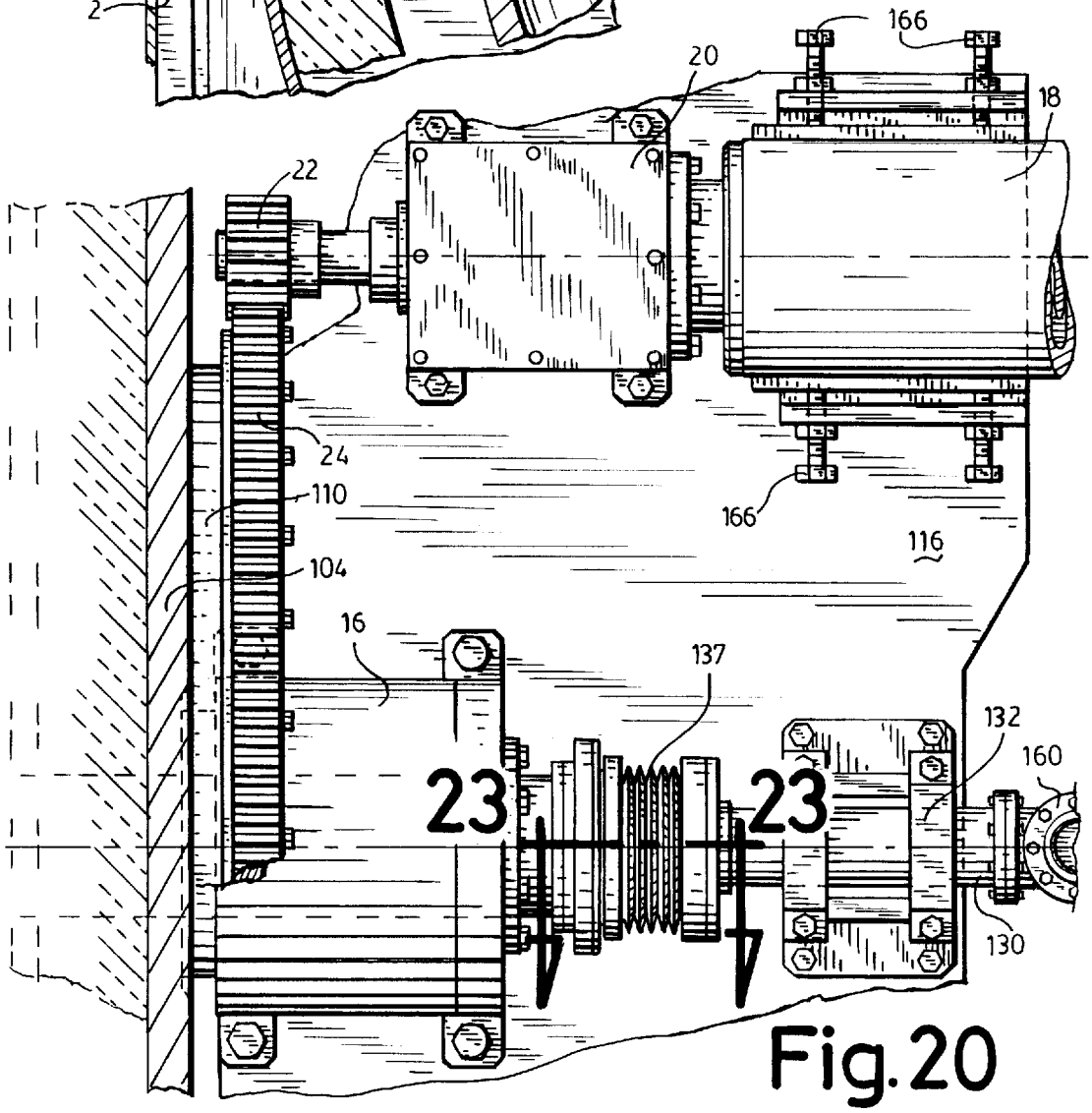
FIG. 20 is a top plan view taken along line 20 of FIG. 16.

Referring to FIG. 20, it is seen that the variable speed electric motor 18 and reducer box 20 can be laterally adjusted by bolts 166 to enable proper meshing of pinion 22 with gear wheel 24.

Figure 23:
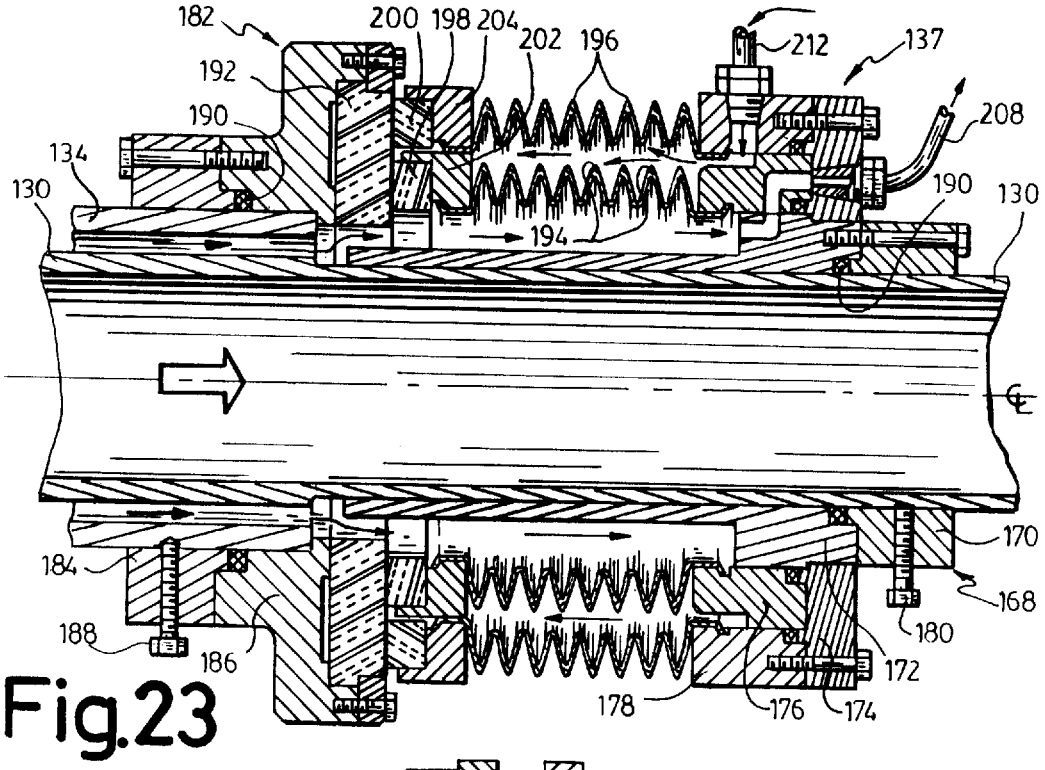
FIG. 23 is a longitudinal section of a first embodiment of the rotary joint and taken along line 23—23 of FIG. 20.

The rotary sealing joint 137 illustrated in FIG. 16 and 20 is detailed in FIG. 23; this figure shows that the stationary discharge tube section 130 is spacedly surrounded by the sealing tube 134 which rotates since it is secured to the drum 4. A first collar assembly 168 formed of parts 170, 172, 174, 176 and 178, is rigidly secured to stationary discharge tube section 130 by set screws 180. Similarly, a rotating collar assembly 182, consisting of parts 184, 186, surrounds and is tightly secured by set screws 188 to the outer end of rotating sealing tube 134. Seals 190 are provided between collar assembly 168 and tube 130 and collar assembly 182 and sealing tube 134. A radial seal pad 192, for instance made of titanium, is carried by part 186 of the collar assembly 182. Seal pad 192 faces towards collars assembly 168. A pair of concentric accordeon tubes 194, 196, co-axial with discharge tube 130, are fixed at one end to parts 176, 178 respectively of the collar assembly 168 and carry at their other end a pair of annular seal pads 192, 200 respectively supported by inner and outer seal pads supports 202, 204 which are respectively secured to the accordeon tubes 194 and 196. The seal pads 198, 200 are pressed by the tubes 194, 196 against the common seal pad 192. Rotating seal pad 192 slides on the stationary seal pads 198, 200, so as to effectively seal the outlet of the passage between sealing tube 134 and discharge tube section 130. The passage defined inwardly of inner accordeon tube 194, is connected by piping 208 to transducers for recording the pressure inside the drum 4 during the pyrolysing operation, said passage opening into the drum by the space between tubes 130, 134. The space between the accordeon tubes 194 and 196 is connected by piping 212 to a source of inert gas, preferably nitrogen, under pressure. Therefore, in the event of an accidental leakage between seal pads 192 and pads 198 and 200 while drum 4 is under vacuum, an inert gas will automatically be fed to the drum instead of oxygen containing atmospheric air.

Figure 24:
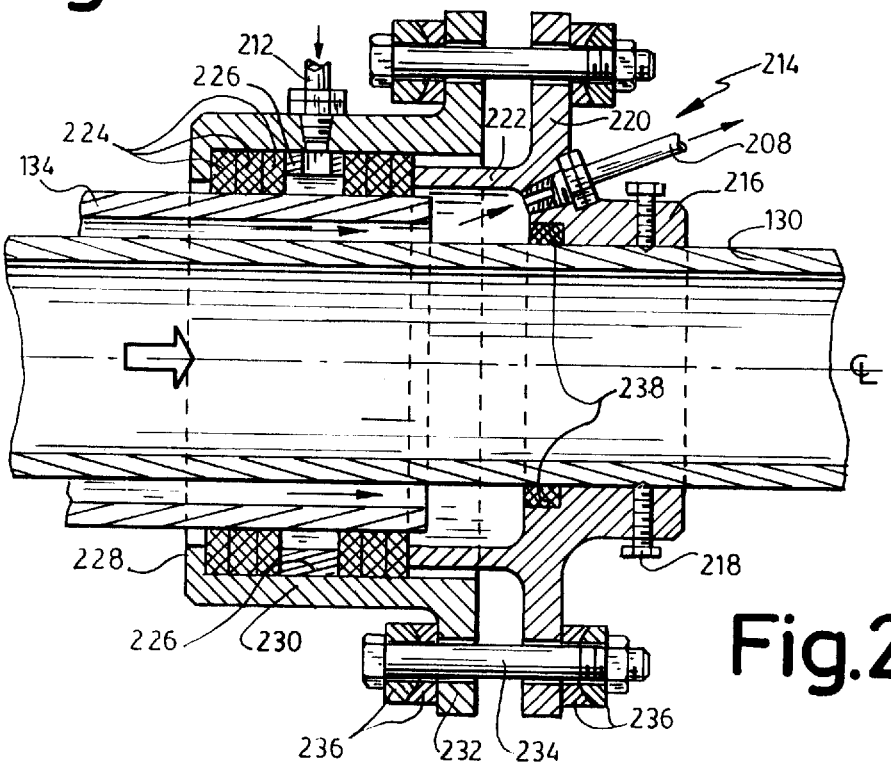
FIG. 24 is a longitudinal section of a second embodiment of the rotary joint.

FIG. 24 shows another embodiment of rotary joint. This joint is a packing gland 214 and includes a collar 216 secured to discharge pipe section 130 by set screws 218 and formed with a radial flange 220 and a cylindrical pusher flange 222. Two sets of packings 224, preferably made of titanium and separated by a metal ring 226, are axially compressed by pusher flange 222 and inward flange 228 of a holding and enclosing collar 230 having a radial flange 232 registering with radial flange 220 of collar 216 and pulled towards each other by bolts 234 inserted through spherical washers 236. Ring 226 is provided with a hole in register with the piping 212 for admission of an inert gas such as nitrogen in case of leakage of the packings 224 which are in frictional contact with the rotating sealing tube 134. As in the previous embodiment, piping 208 is connected to a sensor for taking pressure readings within the drum 4 through the space between sealing tube 134 and discharge tube section 130. Spherical bearings 236 allow for possible axial misalignment between tubes 130 and 134 and consequently between collars 216 and 230. A seal 238 seals collar 216 to tube 130.

Figure 31:
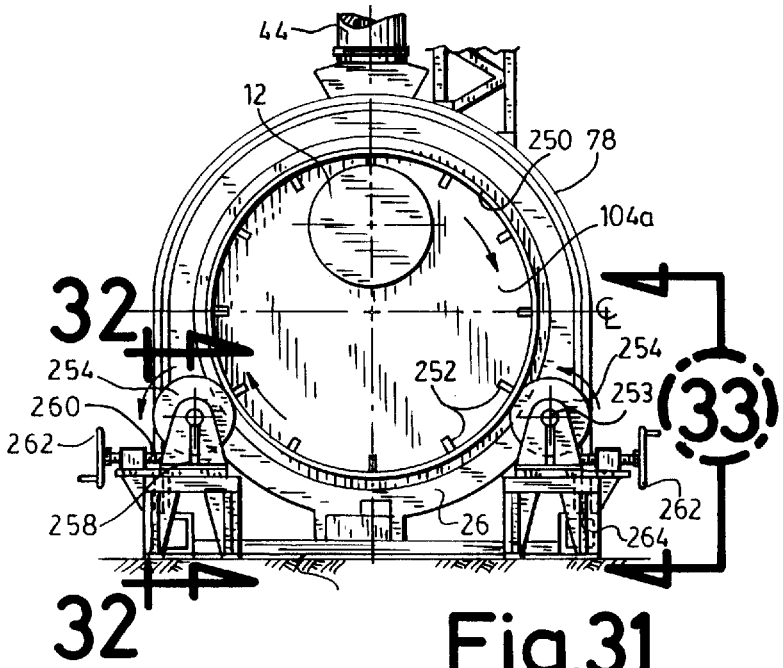
FIG. 31 is a front end elevation similar to that of FIG. 5 showing another bearing system for the front end of the rotary drum.
Figure 33:
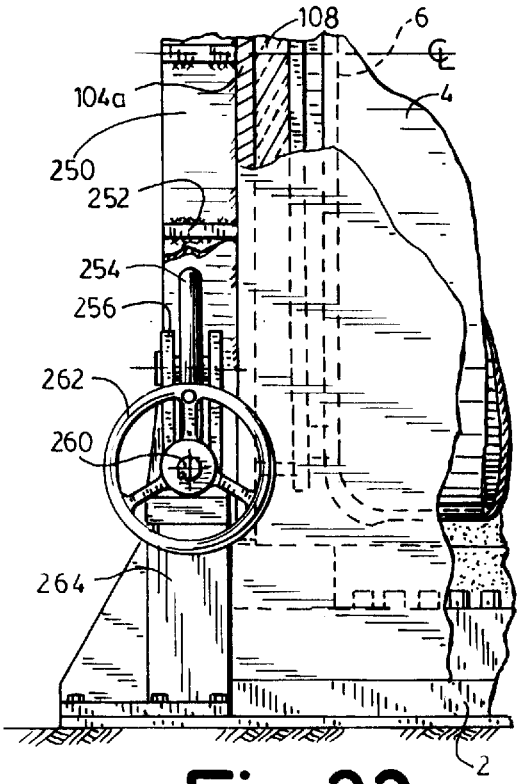
FIG. 32 and 33 are views taken along section line 32—32 and line 33 respectively of FIG. 31.
Figure 32:
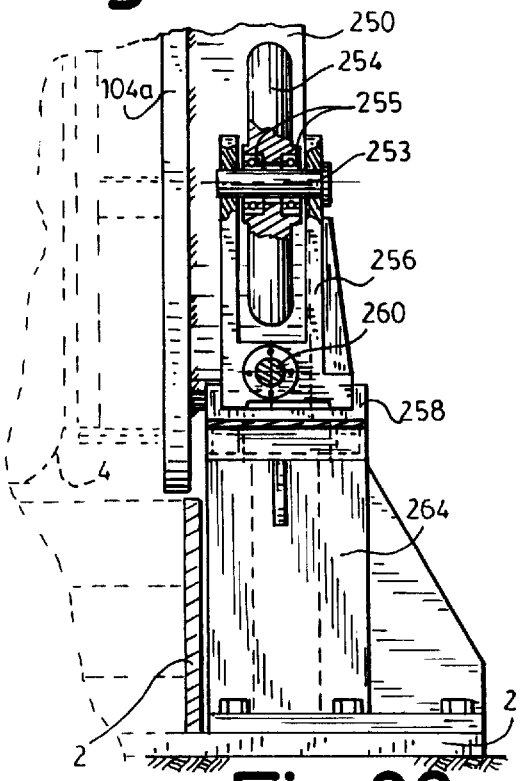
Figure 34:
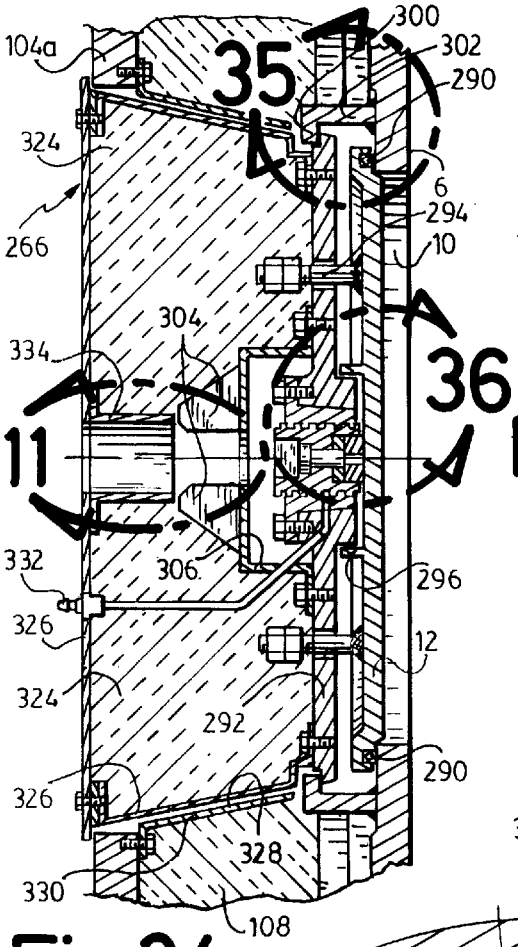
FIG. 34 is a cross section taken along line 34—34 of FIG. 16 and showing the first embodiment of the door assembly.
Figure 35:
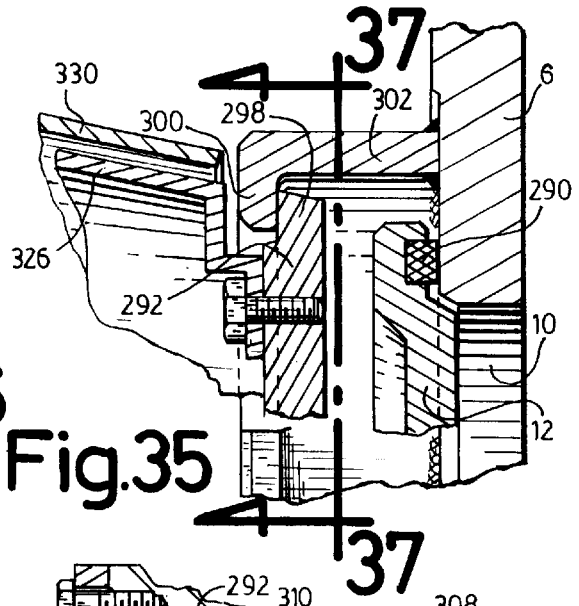
FIGS. 35 and 36 are enlarged longitudinal sections taken in areas 35 and 36 respectively of FIG. 34.
Figure 36:
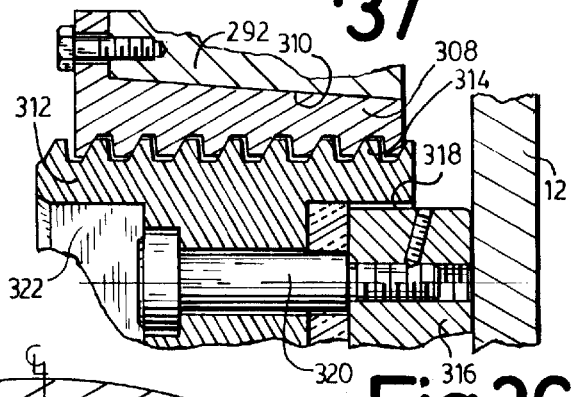
Figure 37:
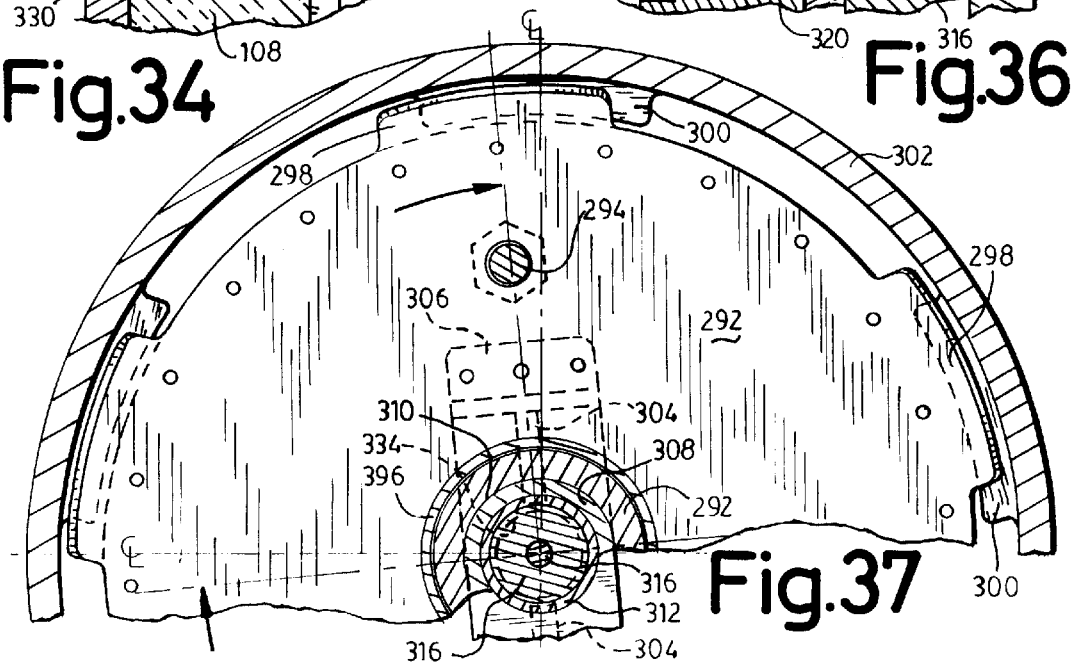
FIG. 37 is a cross section taken along line 37—37 of FIG. 35.

FIGS. 31 to 33 illustrate an alternative to the front bearing 14, stud shaft 122 and lever support 118, previously shown in FIGS. 16 and 18. This bearing system is replaced by a concentric ring 250 secured to the outside of disk 104A and reinforced by inner braces 252. A pair of rollers 254 ride on the outside of ring 250 to support drum 4 at its front end. Each roller 254 is rotatably mounted by bearing 255 on a shaft 253 fitted within a U shape bracket 256 which is laterally horizontally movable in a slide 258 and adjustable by a screw 256 operated by hand wheel 262. Therefore the distance between the two rollers 254 can be adjusted so as to make a vertical adjustment of the front end of drum 4. Similarly, drum 4 can be adjusted in a horizontal direction by simultaneously horizontally shifting the two rollers to the right or to the left. The two rollers 254 which are made of steel with a rounded rim allow a longitudinal displacement of the ring 250 with respect to the same to compensate for thermal expansion and contraction of the drum 4. The two rollers are preferably located at four hour and a half and seven hour and a half with respect to the drum axis, the access opening 12 being located at 12 o'clock in FIG. 31. The two slides 258 are mounted on tables 264 fixed to the base structure 2.

Figure 7:
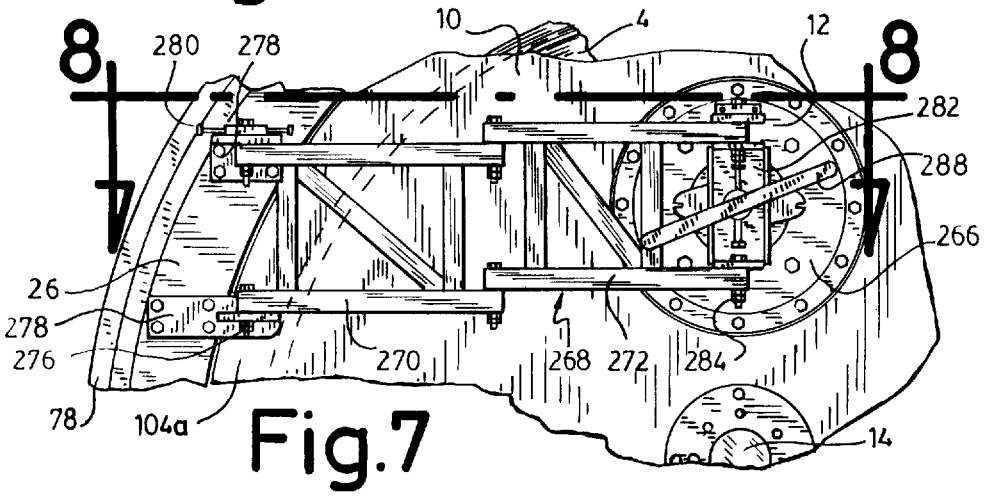
FIG. 7 is a partial front elevation taken in area 7 of FIG. 5.

The door 12 for closing the access opening 10 of drum 4 is part of a door assembly 266 which is removably supported by a door supporting articulated arm 268. This articulated arm is illustrated more particularly in FIGS. 5, 7, 8 and 12 and comprises a radially inner truss 270 and a radially outer truss 272 which are interconnected by pivots 274. Inner truss 270 is pivoted at 276 to brackets 278 fixed to the sheath 26. Arm 268 swings in a horizontal plane and this can be adjusted by the adjustment bolts 280 for the top pivot 276 (see FIG. 7). The outer end of the outer truss 272 carries a bracket 282 by means of pivots 284. Pivots 274, 276 and 284 are all vertical. When the door assembly 266 is attached to bracket 282 an operator standing on a wheeled platform 286 (see FIG. 4 and 5), using a handle 288 carried by bracket 282 can swing the door assembly into an out of the way position with respect to the drum access opening 10 located at 12.00 o'clock. The reverse movement is effected to return the door assembly to a drum closing position.

Referring to FIGS. 34 to 37, the door assembly 266 comprises the circular door 12 which is fitted at its periphery with a gasket 290 to be applied to the front end wall 6 at the periphery of the access opening 10. A door supporting and locking disk 292 is retained on the outside of door 6 and co-axial therewith by means of a series of bolts 294 and by an annular central rib 296 secured to and projecting outwardly from door 12 and respectively slidably engaging registering holes and a central cylindrical cavity of locking disk 292. Therefore, door 12 is retained concentric with locking disk 292 but can move axially with respect to the same. Locking disk 292 has at its periphery a series of outwardly protruding locking ears 298 which when the disk 292 together with the door 12 is rotated through about 35 degrees, come into interlocking registering relationship with mating ears 300 inwardly protruding from a sleeve 302 secured to front end wall 6 and co-axially surrounding access opening 10. Rotation of the locking disk 292 is effected by applying a torque to ears 304 which are diametrically arranged about the door axis and secured by a bracket 306 to the locking disk 292.

A nut 308 is secured in a central tapered bore 310 of locking disk 392; a screw 112 is screwed within the nut 308 by means of German type threads 314; a central pressure pad 316 is applied against the center of the door 12 and is retained in a cavity 318 of screw 312 by means of a shoulder bolt 320. The opposite end of screw 312 is provided with a square cavity 322 for receiving the square tip of a screwdriver to be detailed hereinafter. Therefore, once locking disk 292 has been rotated to interlocked position by the torque applying ears 300, it is held against axial movement away from door 6 and therefore pressure pad 316 can be forced against the center of the door to firmly apply the gasket 290 against end wall 6 by rotation of screw 312 within nut 308. Therefore, a sealed closure is obtained for the drum even if the latter is slightly above atmospheric pressure.

Referring again to FIG. 34, it is seen that the door assembly includes heat insulation 324 retained on the outside of locking disk 292 by a metallic envelope 326. Door assembly 266 has an overall frusto conical shape for easier door opening and closing movement within the frusto conical cavity 328 defined by heat insulation 108 and its metal lining 330. If necessary, threads 314 may be greased by means of a zerk 332.

Envelope 326 carries an inwardly protruding guide bushing 334 centrally of the door assembly to guide a tool, carried by swing arm 268 for removably supporting and for rotating locking disk 292 and screw 312.

Figure 10:
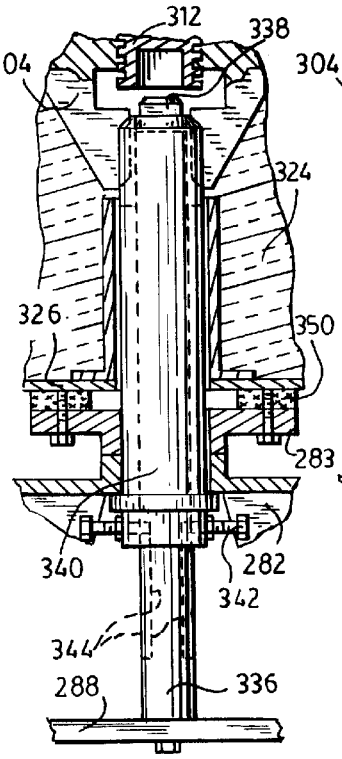
Figure 13:
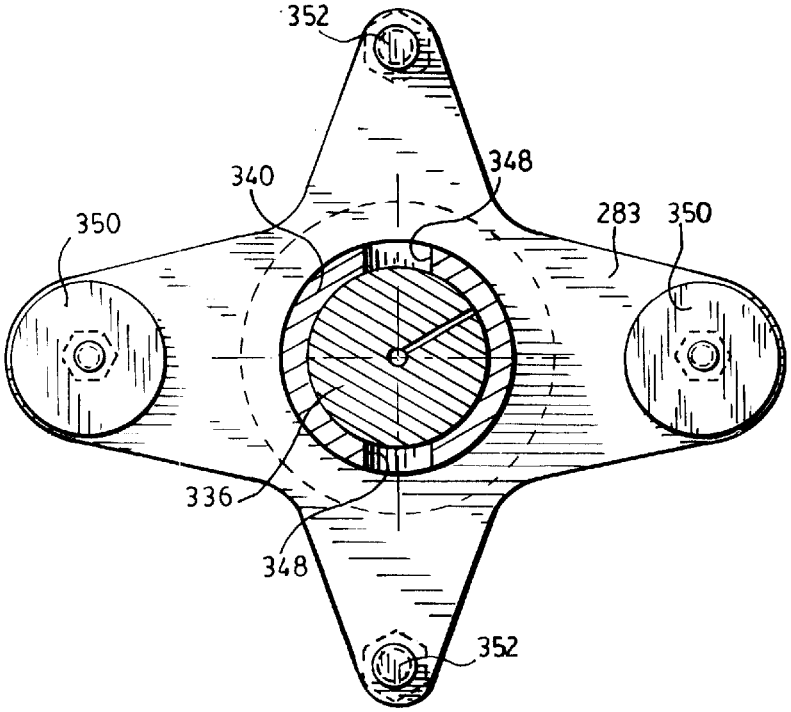
FIG. 13 is a partial cross section taken along line 13—13 of FIG. 12.
Figure 14:
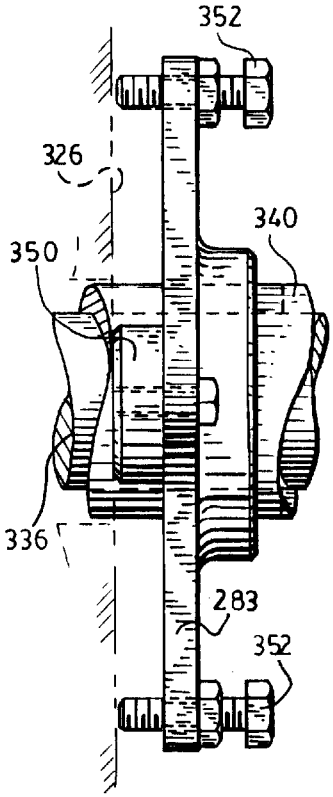
FIG. 14 is a side elevation of the parts illustrated in FIG. 13.

This tool is illustrated in FIGS. 8 to 11. It comprises an elongated cylindrical screwdriver 336 having a square tip 338 for engaging screw cavity 322 and rotating screw 312 by means of transverse handle 288 at the outer end of the screwdriver 336. Screwdriver 336 is axially shiftable within a locking disk rotating tube 340 between the advanced and retracted positions shown in FIG. 9 and 11, when lateral set screws 342 carried by tube 340 reach the ends of a pair of diametrically opposed longitudinal grooves 344 made in screwdriver 336. Tube 340 is axially shiftable within bracket 282 between two limit positions, namely the advanced position shown in FIG. 10 and the retracted position shown in FIG. 9 and 11. The outer end of tube 340 is provided with a flange 346 which abuts against support 382 in the fully advanced position of this tube, as shown in FIG. 10. In this advanced position, locking disk rotating ears 304 are engaged within a pair of longitudinal grooves 348 which are diametrically opposed and longitudinally extend on the outside of tube 340. Door assembly support bracket 282, which is carried at the outer end of the articulated arm 268, is fitted with a door holder 283 to which is fixed a pair of permanent pagnets 350, see FIG. 12, 13 and 14, to removably adhere to metal envelope 326 of the door assembly to the support bracket 282 so that the door assembly will not fall off swing arm 268; holder 283 is further provided with push bolts 352 are screwed against metal envelope 326 to release the magnets therefrom.

Figure 8:
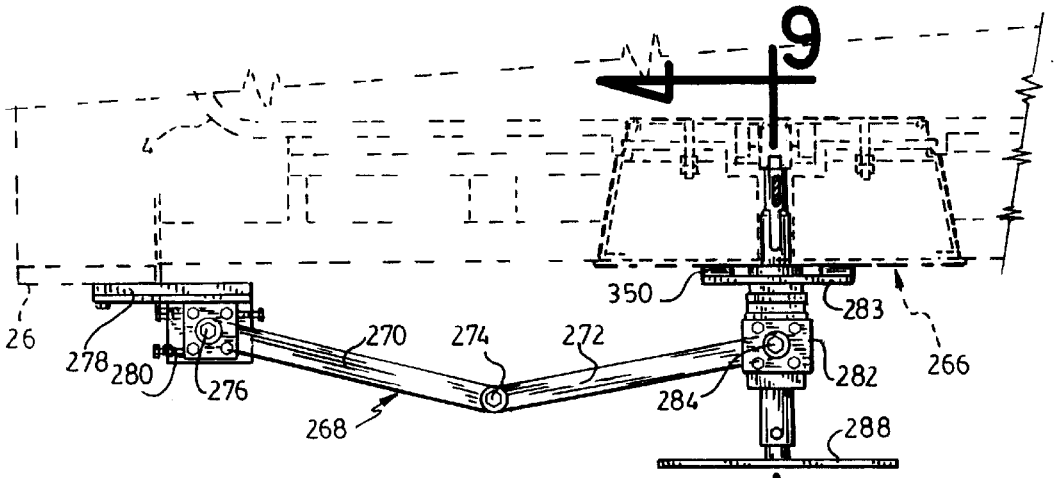
FIG. 8 is a top plan view of the swing arm for carrying the door and taken along line 8—8 of FIG. 7.
Figure 9:
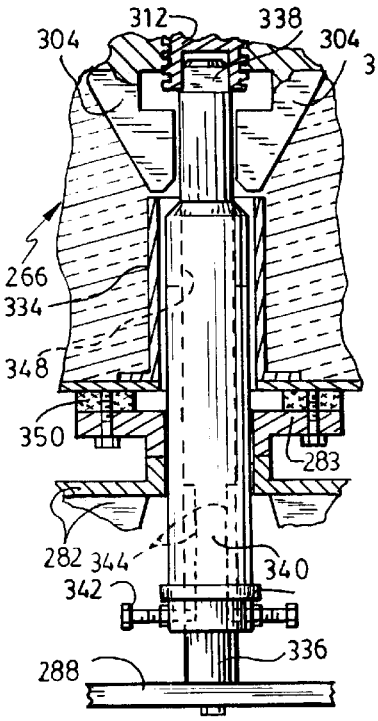
FIGS. 9, 10 and 11 are partial cross sections, taken along line 9—9 of FIG. 8 and in area 11 of FIG. 34, showing various positions of the system for locking and sealing the access door in position on the drum.
Figure 11:
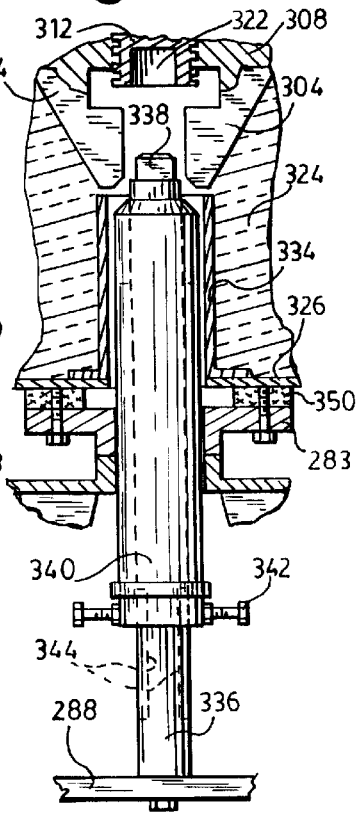
Figure 12:
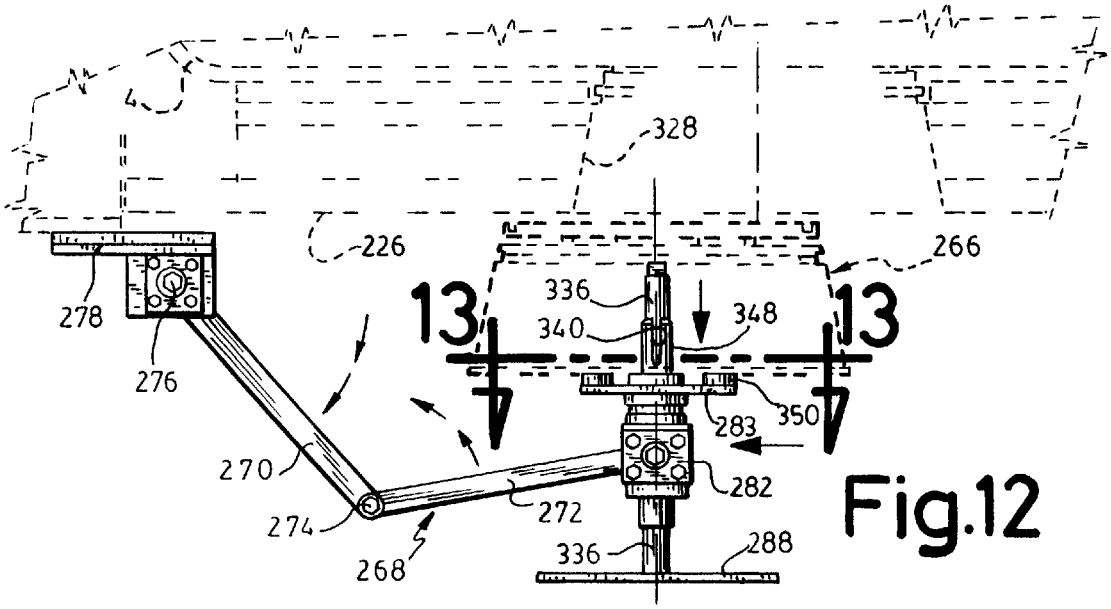
FIG. 12 is a view similar to that of FIG. 8 but showing how the door is removed by operating the swing arm.

With the magnets 350 adhering to the door assembly, FIGS. 8 and 12 show how the door assembly 266 can be bodily withdrawn from the drum and moved outwardly by the folding movement of the articulated arm 268. For this withdrawal movement, the operator pulls on handle 288, the tool being shown in withdrawn limit position, as shown in FIG. 11. Once the door assembly is in position within frusto conical hole 328, tube 340 is advanced and screwdriver 336 is retracted to the positions shown in FIG. 10 whereby tube rotation through handle 288 will rotate and lock the locking disk 292 with the mating ears 300 as previously described in relation to FIG. 34 to 37; then the screwdriver 336 is fully advanced to the position of FIG. 9 while tube 340 is retracted to clear ears 304. In this position, the tip 338 of screwdriver 336 engages the square cavity 322 of screw 312 whereby the latter can be rotated so as to push inwardly against the center of the cover 12 to effect a perfect seal between the cover 12 and the end wall 6 of the drum. Then permanent magnets 350 are released from the door assembly 266 by screwing push bolts 352 and handle 288 is used to pull the assembly of parts 336, 340, 282, 233 away from guide brushing 334. The assembly is swung away from the drum 4 by articulated arm 268.

FIGS. 38 to 41 show another embodiment for removably attaching the door assembly to the articulated arm 268 and for closing access opening 10 in a fluidtight manner. In this case, pressure on the gasket 290 is applied in direct register therewith instead of applying pressure to the center of the door which might loose its elasticity when subjected to very high temperature. Door 12 carries on the outside a cylindrical pusher ring 354 in register with door gasket 290. Metal envelope 326 rests on the outer edge of cylindrical pusher ring 354. An externally threaded ring 356 is secured to the disk 104*a* and protrudes outwardly from the door assembly 266*a*, when the latter is in operative position. An annular cap 358 of U shape cross section is held concentric with the door assembly by means of a cylindrical wall 360 secured to envelope 326. More particularly, the internal leg 362 of the annular cap 358 slides axially on the cylindrical wall 360 until it abuts against the outwardly flared edge 364 of wall 360. Outer leg 366 of cap 358 is inwardly threaded and can be screwed on the internal threads of the ring 356 so that the inner leg 362, which is in register with the cylindrical pusher 354 will apply direct pressure on the gasket 290. To rotate annular cap 358, the operator insert a lever rod 368 into a radial hole 370 of annular cap 358. Cap 358 is rotated in the opposite direction to unscrew it from ring 356 and allow removal of the door assembly 266*a*. To remove the door and to retain it on the articulated arm 268, a rod 372 carried by the support bracket 282 at the end of the articulated arm 268 is provided with lateral bayonet pins 374 which are inserted within bayonet slots 376 of a holding tube 378 fixed to the center of door 12. Operation of the handle 288 will lock rod 372 within the bayonet slots 376 of holding tube 378; release of the holding rod 372 will leave the door assembly in closing position on the drum and allow removal of the articulated arm 268 so that the drum may rotate. A quarter turn rotation of the annular cap 358 is sufficient to firmly seal the door 12 against the end wall 6 of the drum 4.

Figure 38:
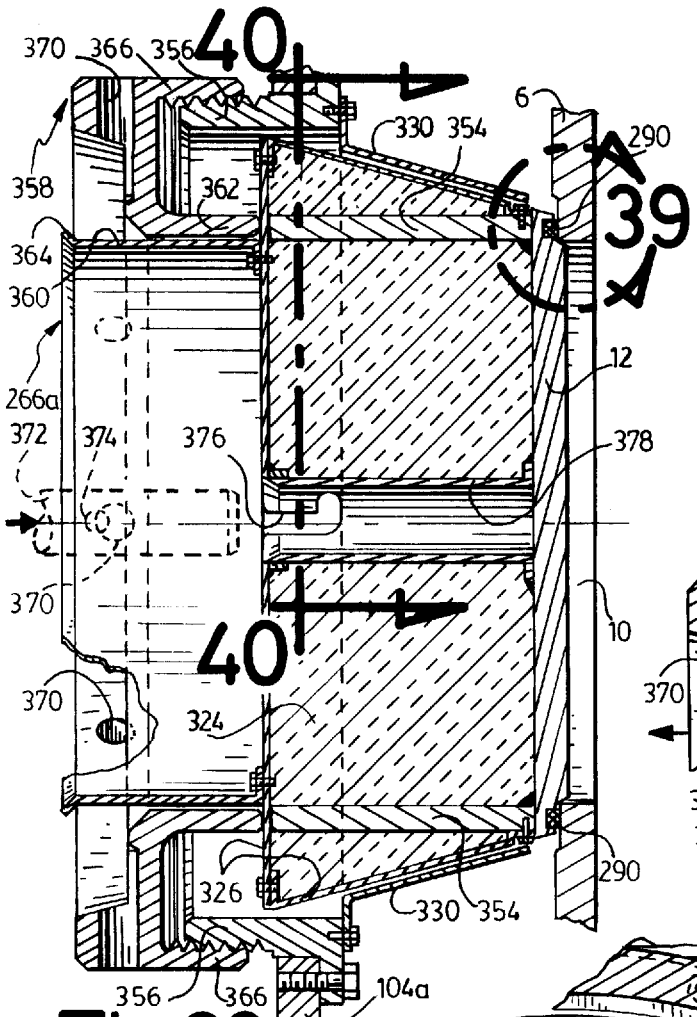
FIG. 38 is a vertical section of a second embodiment of the door assembly.
Figure 39:
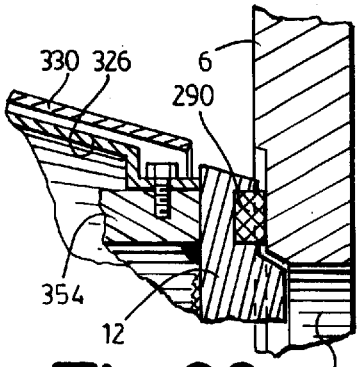
FIG. 39 is a longitudinal partial section on an enlarged scale taken in area 39 of FIG. 38.
Figure 41:
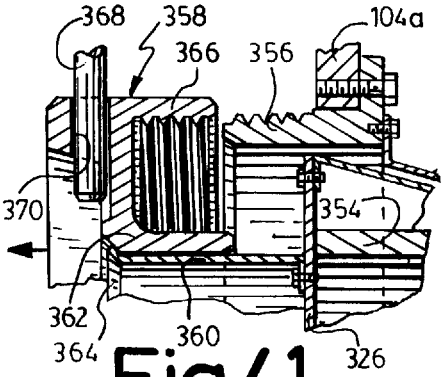
FIG. 41 is a longitudinal section of part of FIG. 38.
Figure 40:
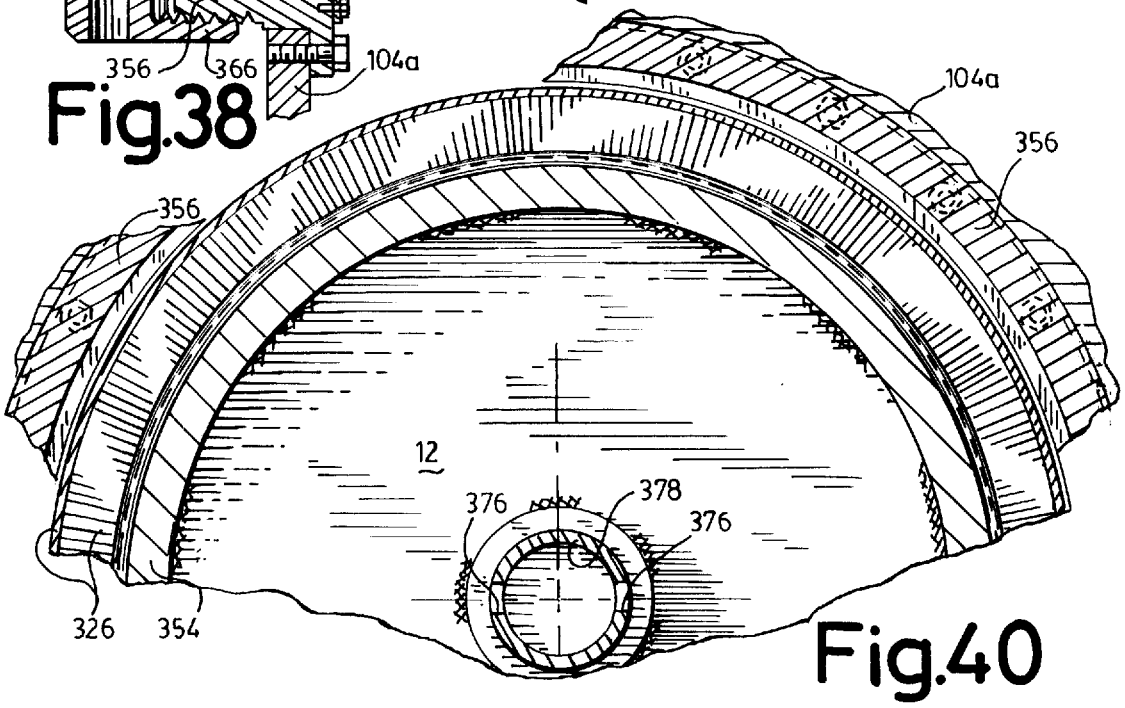
FIG. 40 is a partial section taken along line 40—40 of FIG. 38.
Figure 42:
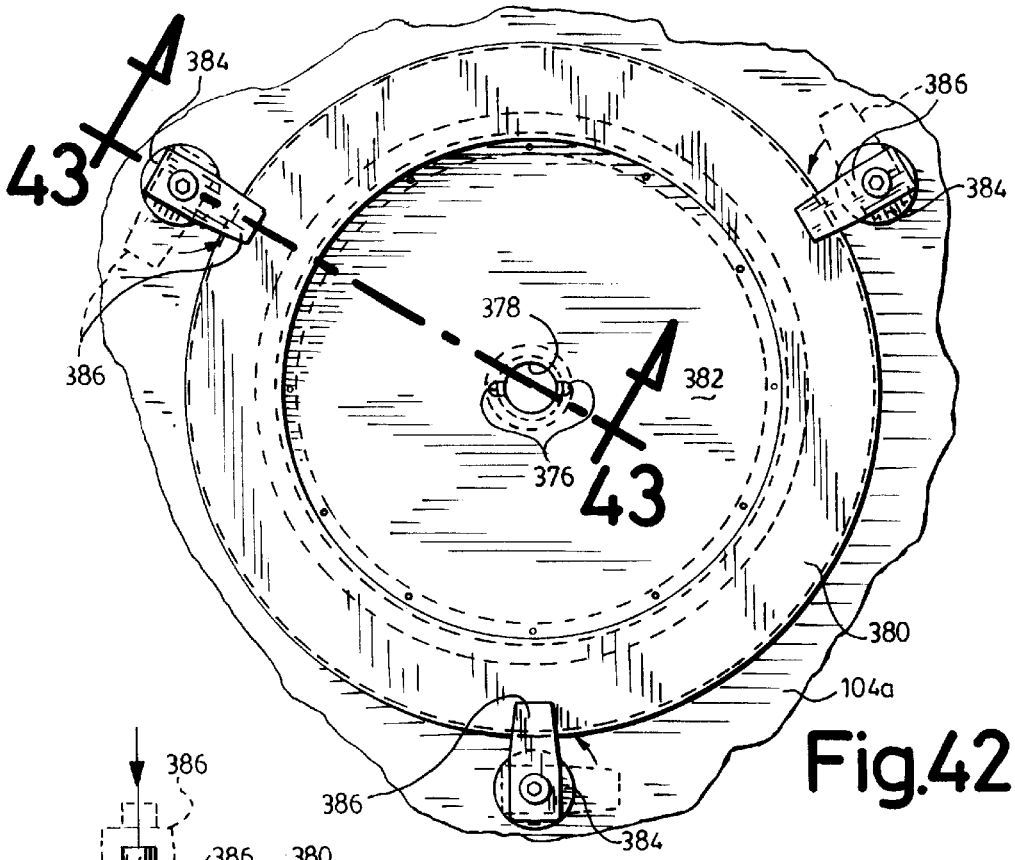
FIG. 42 is an elevation of a third embodiment of the door assembly.
Figure 43:
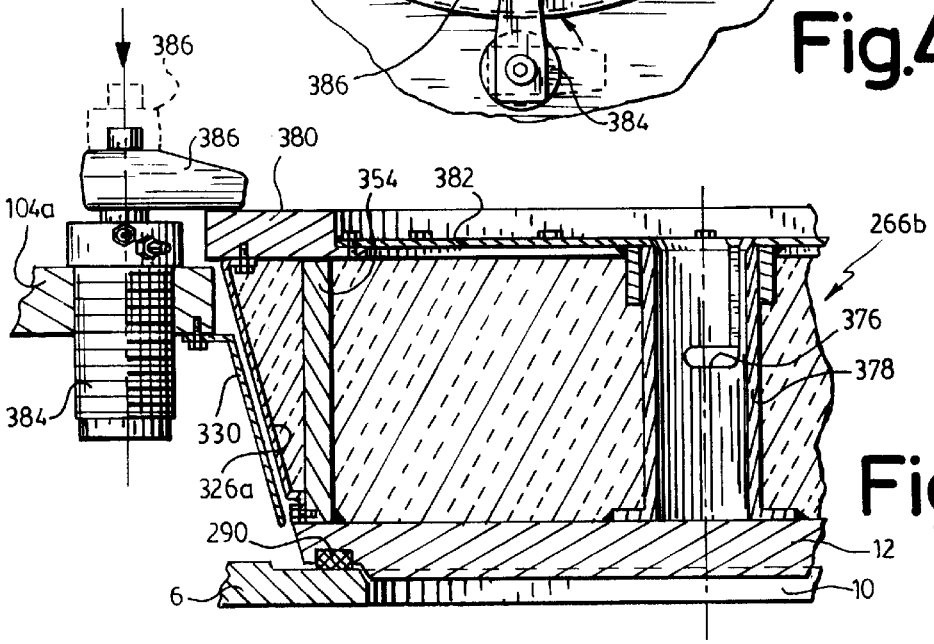
FIG. 43 is a partial cross section taken along line 43—43 of FIG. 42.

FIGS. 42 and 43 show a third embodiment for sealing the door assembly indicated at 266*b*, which comprises as in the second embodiment, a cylindrical pusher 354 secured to the door 12 on which is applied a flat ring 380, which is secured to the door 12 by a conical metal envelope 326*a* and a disk 382 secured to holding tube 378, the latter fixed to door 12 as in the embodiment of FIG. 38 and also provided with bayonet slots 376. Three angularly equally spaced swing cylinders 384 are mounted around the door assembly on the drum supporting disk 104*a* and provided with clamping arms 386. These swing cylinders with clamping arms 386 are of known construction, they are simple action hydraulic cylinders with a cam to swing open the clamp arms 386 to a 90 degrees position shown in dotted line in FIG. 43 in order to clear ring 380. They can be operated by a manual hydraulic pump. Here again, direct pressure is applied against the seal 290.

Referring to FIGS. 1, 2 and 3 there is illustrated a flow diagram of the instrumentation and equipment used in association with the apparatus of the invention when the same serves to pyrolyse used tires. In a cognate patent application entitled "Vacuum pyrolysis of scrap tires" co-inventors, Richard Bouziane and Rodier Michaud, a process for pyrolysing scrap tires under vacuum is described which is advantageously carried out within the apparatus of the invention with the instrumentation shown is FIGS. 1, 2 and 3. Therefore, only a succinct description of the equipment is furnished. The apparatus and adjacent associated equipment previously described, are indicated by the same reference numerals in FIG. 1. Used rubber tire cuttings indicated at 400 are loaded into drum 4 which is rotated by drive 18, 20 and heated by gas burner 180 which is initially supplied with natural gas from reservoir 402. Drum 4*a* is initially evacuated by a double stage vacuum pump 404 (see FIG. 2) connected to the discharge tube 130, 160 through line 406, 408, separator 410, line 412, condenser 414 and line 416. The rubber content of the tire clippings 400 form vapors and gases which are filtered through filters 152; the vapors are condensed in condensor 414 and the oil and gas mixture flows through line 412 into separator 410 from which the oil component is fed to oil reservoir 418 through line 420. The oil from reservoir 418 is sold as fuel oil to be transported by tank trucks 422. The gas component from separator 412 is sucked by vacuum pump 404 through line 408, 406. The gases which are initially produced are poor in hydrocarbon content and are fed to the flare 424 through line 426. Upon the gas hydrocarbon content reaching a minimum level, they are fed from line 426 to process gas reservoir 428. This process gas is then used to feed the gas burner 38 after switching off of the natural gas source 402. As soon as an exothermic reaction takes place within the drum, vacuum pump 404 is stopped and a gas circulating pump 430 is started to pressurize the process gas within gas reservoir 428.

The cooling coil 432 of the condenser 414 is fed with a water and glycol mixture from reservoir 434, this circuit is cooled in a heat exchanger 436 by a liquid circuit comprising the cooling water tower 438 and water reservoir 440.

The nitrogen source connected to the rotary joint 137 through piping 212 is indicated at 442. A second nitrogen source 444 is used for sweeping away atmospheric air after the same has been used through air intake 446 to effect back wash of the filters 448 on the inlet and outlet side of condenser 414.

A plurality of temperature, pressure and gas component detecting sensors are installed in the oven and equipment circuit and the data is transmitted to a central computer through suitable transmitters. Referring to FIG. 1, it is seen that chimney 44 is equipped with sensors 450 for reading the oxygen, the carbon monoxide and the total hydrocarbon contents of the effluent gases and these readings are transmitted by transmitter 452 to a control computer to operate the various valves motors and air fans.

We claim:

1. A pyrolysing apparatus comprising a base structure, a drum having a front and a back end wall and supported on said base structure for rotation about a generally horizontal longitudinal axis, drive means for rotating said drum, said drum having an access opening in said front end wall for loading materials to be pyrolysed and for unloading solid residues, a door removably closing said access opening in an airtight manner, heating means located adjacent and exteriorly of said drum for heating the same as it rotates together with its contents at a high temperature in an oxygen free environment, a heat insulating sheath spacedly surrounding said drum and secured to said base structure, a chimney mounted on said base structure communicating with the space between said drum and said sheath, a stationary discharge tube having an inner portion entirely located longitudinally within said drum and a co-axial portion extending through said back end wall co-axial with said drum axis and fixedly supported on said base structure outwardly of said drum, gas collecting means provided along said discharge tube inner portion for collecting gazeous emanations originating from the pyrolysed materials into said discharge tube, and sealing means between said drum and said stationary discharge tube.

2. An apparatus as defined in claim 1, further including a sleeve co-axial with and spacedly surrounding said discharge tube co-axial portion, and secured to the exterior of said back end wall, back bearing means for rotatably supporting said sleeve and for preventing axial displacement thereof and front bearing means for rotatably supporting said drum at said front end wall while allowing thermal axial expansion of said drum.

3. An apparatus as defined in claim 2, wherein said sheath has circular end openings co-axial with said drum and further including drum supporting front and back insulated discs co-axial with said drum and spacedly secured to said front and back end walls respectively exteriorly of said drum, heat insulation between said discs and said end walls, said insulated discs closing said sheath end openings.

4. An apparatus as defined in claim 3, wherein said disk of said front end wall has an external stud shaft co-axial with said drum and suppported by said front bearing and further including a bearing support lever arm pivoted to said base structure and to said front bearing for allowing axial displacement of said front bearing.

5. An apparatus as defined in claim 3, wherein said front bearing includes two rollers supporting said front end wall insulated disc on each side of said drum axis.

6. An apparatus as defined in claim 5, further including means to adjust the spacing of said two rollers transversely of said drum.

7. An apparatus as defined in claim 3, wherein said drive means include a large diameter gear wheel fixed to the exterior of said back end wall insulated disc and spacedly surrounding said back bearing and a variable speed power drive carried by said base structure in driving engagement with said gear wheel.

8. An apparatus as defined in claim 1, wherein said discharge tube inner portion is upwardly offset relative to said drum longitudinal axis.

9. An apparatus as defined in claim 8, wherein said discharge tube inner portion has a closed end proximate said front end wall and further including an internal axial stud shaft fixed to said front end wall, protruding within said drum, a collar rotatably supported on said internal stud shaft and a lever pivoted to said collar and to said inner portion adjacent said closed end for allowing longitudinal thermal expansion and contraction of said discharge tube axially of and relative to said drum.

10. An apparatus as defined in claim 8, wherein said sheath has circular end openings co-axial with said drum and further including drum supporting front and back insulated discs co-axial with said drum and spacedly secured to said front and back end walls respectively exteriorly of said drum, heat insulation between said discs and said end walls, said insulated discs closing said sheath end openings, wherein said sealing means include a sealing tube co-axial with said drum, secured to said back end wall extending exteriorly of said back end wall insulated disc spacedly through said sleeve, said sealing tube rotatably surrounding said co-axial portion of said discharge tube and a rotary joint between said sealing tube and said co-axial portion of said discharge tube said rotary joint located exteriorly of said sleeve and back bearing.

11. An apparatus as defined in claim 10, wherein said rotary joint include a sealing tube collar fixed to the outer end of said sealing tube a common radial pad carried by said sealing tube collar, a discharge tube collar fixed to said discharge tube co-axial portion, a pair of concentric radial pads in sliding and sealing engagement with said common radial pad, a pair of concentric accordeon tubes surrounding said discharge tube co-axial portion sealingly and respectively secured to said pair of radial pads and to said discharge tube collar, and a source of pressurized inert gas connected to the space between said pair of radial pads and said concentric tubes, so as to prevent entrance of outside air within said drum when said drum is under vacuum and which might be due to leakage between said common pad and said concentric pads.

12. An apparatus as defined in claim 11, further including a passage between said discharge tube axial portion and the inner one of said concentric accordeon tubes in communication with the inside of said drum through the space between said sealing tube and said discharge tube axial portion for connection to a pressure transducer.

13. An apparatus as defined in claim 10, wherein said rotary joint includes a packing gland formed of two sets of packing rings pressed against said rotating sealing tube and secured to said discharge tube axial portion, spacer means between said two sets of packing rings and a source of pressurized inert gas to prevent infiltration of atmospheric air into said drum when the same is under vacuum and due to leakage between said packing rings and said discharge tube axial portion.

14. An apparatus as defined in claim 8, wherein said gas collecting means comprises a plurality of filters depending from and communicating with said discharge tube inner portion.

15. An apparatus as defined in claim 1, wherein said chimney includes a butterfly valve to close the same and said sheath is provided with ventilation openings communicating with the atmosphere and disposed below said drum and motorized trap doors for closing said ventilation openings.

16. An apparatus as defined in claim 15, further including power operated air blower means to circulate cooling air within the space between said sheath and said drum.

17. An apparatus as defined in claim 1, wherein said access opening is eccentrically disposed with respect to said drum axis.

18. An apparatus as defined in claim 17, further including a door assembly incorporating said door, a swinging arm pivotally connected to said base structure at one end and removably pivotally connected to said door assembly at its other end, said arm holding said door assembly at an access opening closing position when said drum is rotated to a position with said access opening in uppermost position, said swinging arm swinging said door to an access opening clearing position to permit drum loading and unloading.

19. An apparatus as defined in claim 18, wherein said door assembly includes a door support, rotary interlocking means carried by said door support and by said front end wall around said access opening to lock said door support to said front end wall by a limited angle of rotation of said door support relative to said front end wall, said door supported by said door support for relative axial movement but against relative radial movement, a nut secured to said door support, a screw within said nut, a pressure pad carried by said screw in register with the center of said door, a screwdriver to screw said screw within said nut to push said pressure pad, a sleeve within which said screwdriver is mounted for limited rotation therewith and for axial movement between advanced and retracted position respectively engaging and releasing said screw, a handle carried by said screwdriver for axially shifting and rotating the same and also for axially shifting said sleeve relative to said screwdriver and for rotating said sleeve, interengagable means carried by said door support and by said sleeve which when interengaged cause rotation of said door support by rotation of said handle in advanced position of said sleeve and in said retracted position of said screwdriver and which are disengaged in a retracted position of said sleeve and a mounting bracket pivoted to said swing arm and carrying said sleeve and said screwdriver.

20. An apparatus as defined in claim 19, wherein said mounting bracket carries permanent magnets to releasably adhere to said door assembly so that it may be carried by said swing arm and further including screws carried by said mounting bracket and screwable to exert a pressure on said door assembly to move said magnets away from the same.

21. An apparatus as defined in claim 18, wherein said door assembly includes a central holder and a peripheral ring secured to and outwardly protruding from said door, heat insulation filling said ring around said central holder, a circular seal between said door and the edge of said access opening, said ring registering with said seal when said door is in closed position, and pressure exerting means carried by said drum to press said door against said seal and releasable to clear said ring and allow door removal while supported by said swing arm through said central holder.

22. An apparatus as defined in claim 21, wherein said pressure exerting means are hydraulic swing cylinders carried by said drum and clamp arms actuated by said swing cylinders between an operative position pressing against said ring and inoperative position clearing said ring.

23. An apparatus as defined in claim 21, wherein said pressure exerting means include a threaded collar carried by said drum and co-axial with and surrounding said access opening, and a threaded cap releasably screwed on said collar and rotatably carried by said door, said cap having a radially inner cylindrical flange rotatable relative to, registering with and pressing said ring against said seal when said cap is screwed on said collar.

24. An apparatus as defined in claim 1, further including heat transmitting fins protruding from and secured to the inside of said drum and extending in planes normal to said drum axis.

25. An apparatus as defined in claim 1, wherein said heat insulating sheath has a longitudinal slot parallel to and vertically below the drum axis, and of a length about equal to the length of said drum, said heating means including a series of burner tips extending within said slot.

* * * * *